US011760112B2

(12) United States Patent
Praharaj et al.

(10) Patent No.: US 11,760,112 B2
(45) Date of Patent: Sep. 19, 2023

(54) AIRFLOW CONTROL IN A PRINTING SYSTEM, AND RELATED DEVICES, SYSTEMS, AND METHODS

(71) Applicant: XEROX CORPORATION, Norwalk, CT (US)

(72) Inventors: Seemit Praharaj, Webster, NY (US); Douglas K. Herrmann, Webster, NY (US); Jason M. LeFevre, Penfield, NY (US); Chu-Heng Liu, Penfield, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 24 days.

(21) Appl. No.: 17/217,466

(22) Filed: Mar. 30, 2021

(65) Prior Publication Data

US 2022/0314650 A1 Oct. 6, 2022

(51) Int. Cl.
*B41J 29/38* (2006.01)
*B41J 11/00* (2006.01)

(52) U.S. Cl.
CPC ..... *B41J 11/0085* (2013.01)

(58) Field of Classification Search
None
See application file for complete search history.

(56) References Cited

U.S. PATENT DOCUMENTS 8,388,246 B2 3/2013 Spence et al.
9,796,546 B1 10/2017 LeFevre et al.
9,815,303 B1 11/2017 Herrmann et al.
9,944,094 B1 4/2018 Herrmann et al.
(Continued)

FOREIGN PATENT DOCUMENTS

CN 104044366 A 9/2014
EP 1449668 A1 8/2004
(Continued)

OTHER PUBLICATIONS

Sugimoto, Recording Device, May 19, 2011, Japan, All Pages (Year: 2011).*

(Continued)

*Primary Examiner* — Erica S Lin
*Assistant Examiner* — Tracey M McMillion
(74) *Attorney, Agent, or Firm* — Jones Robb, PLLC

(57) ABSTRACT

A printing system comprises a printhead to eject ink through an opening in a carrier plate to a deposition region. A print medium is held against a movable support surface by vacuum suction communicated through platen holes of a vacuum platen and transported through the deposition region. An airflow control system comprises upstream and downstream valves associated with the printhead, individually addressable channels for the vacuum platen, or both. The upstream and downstream valves are arranged to selectively block and allow airflow through an upstream side or a downstream side, respectively, of the opening in the carrier plate. Actuation of the upstream and downstream valves may be controlled based on a location of the print medium. The channels are arranged to selectively control the supply of vacuum suction to respectively corresponding columns of platen holes. Actuation of the channels may be controlled based on a size of the print medium.

21 Claims, 23 Drawing Sheets

(56) References Cited

U.S. PATENT DOCUMENTS

| | | | | |
|---|---|---|---|---|
| 10,688,778 | B2 | 6/2020 | Fromm et al. | |
| 2002/0158937 | A1* | 10/2002 | Pietrzyk | B41J 2/04 347/32 |
| 2010/0208018 | A1* | 8/2010 | Snyder | B41J 2/175 347/90 |
| 2010/0276868 | A1 | 11/2010 | Moore et al. | |
| 2011/0248441 | A1 | 10/2011 | Kamada | |
| 2013/0050375 | A1 | 2/2013 | Ishimori et al. | |
| 2016/0347091 | A1 | 12/2016 | Onuma et al. | |
| 2018/0339529 | A1* | 11/2018 | Zirilli | B41J 11/0085 |
| 2020/0345545 | A1* | 11/2020 | Zhang | A61F 9/0008 |
| 2021/0138803 | A1 | 5/2021 | Lefevre et al. | |

FOREIGN PATENT DOCUMENTS

| | | | |
|---|---|---|---|
| EP | 1449668 | B1 | 5/2007 |
| EP | 1 319 510 | B1 | 9/2009 |
| GB | 2 374 834 | A | 10/2002 |

OTHER PUBLICATIONS

Co-Pending Application U.S. Appl. No. 17/217,370, "Airflow Control Through Vacuum Platen of Printing System By a Movable Damper, and Related Devices, Systems, and Methods,", Mar. 30, 2021.

Co-Pending Application U.S. Appl. No. 17/217,388, "Airflow Control in a Printing System Using a Movable Baffle, and Related Devices, Systems, and Methods,", Mar. 30, 2021.

Co-Pending Application U.S. Appl. No. 17/217,399, "Devices, Systems, and Methods for Controlling Mrflow Through Vacuum Platen of Printing System By a Movable Damper,", Mar. 30, 2021.

Co-Pending Application U.S. Appl. No. 17/217,411, "Devices, Systems, and Methods for Controlling Airflow Through Vacuum Platen of Printing System Via Airflow Zones,", Mar. 30, 2021.

Co-Pending Application U.S. Appl. No. 17/217,432, "Controlling Airflow Through Vacuum Platen of Printing System By a Movable Damper, and Related Devices, Systems, and Methods,", Mar. 30, 2021.

Co-Pending Application U.S. Appl. No. 17/217,448, "Devices, Systems, and Methods for Controlling Mrflow Through Vacuum Platen of Printing System By Rotating Valve,", Mar. 30, 2021.

* cited by examiner

AIRFLOW CONTROL IN A PRINTING SYSTEM, AND RELATED DEVICES, SYSTEMS, AND METHODS

FIELD

Aspects of this disclosure relate generally to inkjet printing, and more specifically to inkjet printing systems having a media transport device utilizing vacuum suction to hold and transport print media. Related devices, systems, and methods also are disclosed.

INTRODUCTION

In some applications, inkjet printing systems use an ink deposition assembly with one or more printheads, and a media transport device to move print media (e.g., substrates such as sheets of paper, envelopes, or other substrates suitable for being printed with ink) through an ink deposition region of the ink deposition assembly (e.g., a region under the printheads). The inkjet printing system forms printed images on the print media by ejecting ink from the printheads onto the media as the media pass through the deposition region. In some inkjet printing systems, the media transport device utilizes vacuum suction to assist in holding the print media against a movable support surface (e.g., conveyor belt, rotating drum, etc.) of the transport device. Vacuum suction to hold the print media against the support surface can be achieved using a vacuum source (e.g., fans) and a vacuum plenum fluidically coupling the vacuum source to a side of the movable support surface opposite from the side that supports the print media. The vacuum source creates a vacuum state in the vacuum plenum, causing vacuum suction through holes in the movable support surface that are fluidically coupled to the vacuum plenum. When a print medium is introduced onto the movable support surface, the vacuum suction generates suction forces that hold the print medium against the movable support surface. The media transport device utilizing vacuum suction may allow print media on the movable support surface to be securely held in place without slippage while being transported through the ink deposition region under the ink deposition assembly, thereby helping to ensure correct locating of the print media relative to the printheads and thus more accurate printed images. The vacuum suction may also allow print media to be held flat as it passes through the ink deposition region, which may also help to increase accuracy of printed images, as well as helping to prevent part of the print medium from rising up and striking part of the ink deposition assembly and potentially causing a jam or damage.

One problem that may arise in inkjet printing systems that include media transport devices utilizing vacuum suction is unintended blurring of images resulting from air currents induced by the vacuum suction. In some systems, such blurring may occur in portions of the printed image that are near the edges of the print media. This blurring may occur due to uncovered holes in the media transport device adjacent to one or more of the edges of the print media. In particular, during a print job, the print media are spaced apart from one another on the movable support surface as they are transported in the processing direction through the deposition region of the ink deposition assembly, and therefore parts of the movable support surface between adjacent print media are not covered by any print media. This region between adjacent print media is referred to herein as the inter-media zone. Thus, adjacent to both the lead edge and the trail edge of each print medium in the inter-media zone there are uncovered holes in the movable support surface.

Moreover, there may also be a region of uncovered holes extending alongside an inboard edge of the print medium. One edge of the print media is used to register the print media in the cross-process direction (i.e., the edge is aligned in the cross-process direction with a registration datum), and this edge is referred to herein as the outboard edge. The edge opposite from the outboard edge is referred to herein as the inboard edge. Because the location of the outboard edge in the cross-process direction is fixed, the location of the inboard edge in the cross-process direction will vary depending on the size of the print medium. The holes for vacuum suction are generally arranged to extend across more-or-less the full width of the deposition region in the cross-process direction so that the holes are able to hold down any size of print media that the system is designed to use, from the smallest to the largest sizes. As a result, if the print medium currently being printed is smaller than the largest size, its inboard edge may not extend far enough in the cross-process direction to cover all the holes. Therefore, a region of uncovered holes appears adjacent to the inboard edge of the print medium when a smaller print medium is used.

Because the above-described holes near the lead, trail, and inboard edges are uncovered, the vacuum of the vacuum plenum induces air to flow through those uncovered holes. This airflow may deflect ink droplets, such as for example, satellite droplets, as they are traveling from a printhead to the substrate, and thus cause blurring of the image near those edges.

A need exists to improve the accuracy of the placement of droplets in inkjet printing systems and to reduce the appearance of blur of the final printed media product. A need further exists to address the blurring issues in a reliable manner and while maintaining speeds of printing and transport to provide efficient inkjet printing systems.

SUMMARY

Embodiments of the present disclosure may solve one or more of the above-mentioned problems and/or may demonstrate one or more of the above-mentioned desirable features. Other features and/or advantages may become apparent from the description that follows.

In accordance with at least one embodiment of the present disclosure, a printing system comprises an ink deposition assembly comprising a carrier plate and a printhead arranged to eject a print fluid through a printhead opening in the carrier plate to a deposition region of the ink deposition assembly; a media transport device comprising a movable support surface, the media transport device configured to hold a print medium against the movable support surface by vacuum suction through holes in the media transport device and transport the print media along a process direction though the deposition region; and an airflow control system. The airflow control system comprises an upstream valve associated with the printhead and a downstream valve associated with the printhead. Each of the upstream valve and the downstream valve is transitionable between an open state and a closed state. The upstream valve blocks airflow through an upstream side of the printhead opening in the closed state and allows airflow through the upstream side of the printhead opening in the open state, upstream and downstream being defined based on the process direction. The downstream valve blocks airflow through a downstream side of the printhead opening in the closed state and allows airflow through the downstream side of the printhead opening in the open state.

In accordance with at least one embodiment of the present disclosure, a printing system comprises an ink deposition assembly comprising a carrier plate and a printhead arranged to eject a print fluid through a printhead opening in the carrier plate to a deposition region of the ink deposition assembly; a media transport device comprising a movable support surface, the media transport device configured to hold a print medium against the movable support surface by vacuum suction through holes in the media transport device and transport the print media along a process direction though the deposition region; and an airflow control system. The airflow control system comprises a plurality of channels that are individually transitionable between an on state and an off state, each of the channels associated with at least one column of the holes. Each channel, in the on state, supplies vacuum suction to the at least one column of holes, and each channel, in the off state, does not supply vacuum suction to the at least one column of holes.

In accordance with at least one embodiment of the present disclosure, a printing system comprises an ink deposition assembly comprising a carrier plate and a printhead arranged to eject a print fluid through a printhead opening in the carrier plate to a deposition region of the ink deposition assembly; a media transport device comprising a movable support surface, the media transport device configured to hold a print medium against the movable support surface by vacuum suction through holes in the media transport device and transport the print media along a process direction though the deposition region; and an airflow control system. The airflow control system comprises an upstream valve associated with the printhead and a downstream valve associated with the printhead. Each of the upstream valve and the downstream valve is transitionable between an open state and a closed state. The upstream valve blocks airflow through an upstream side of the printhead opening in the closed state and allows airflow through the upstream side of the printhead opening in the open state, upstream and downstream being defined based on the process direction. The downstream valve blocks airflow through a downstream side of the printhead opening in the closed state and allows airflow through the downstream side of the printhead opening in the open state. The airflow control system also comprises a plurality of channels that are individually transitionable between an on state and an off state. Each of the channels is associated with at least one column of the holes extending in the process direction. each channel, when in the on state, supplies vacuum suction to the associated column of holes, and each channel, when in the off state, does not supply vacuum suction to the associated column of holes.

In accordance with at least one embodiment of the present disclosure, a method comprises transporting a print medium through a deposition region of a printhead of a printing system, and ejecting print fluid from the printhead through a printhead opening in a carrier plate to deposit the ink to the print medium in the deposition region. The print medium is held during the transporting against a movable support surface of a media transport device via vacuum suction through holes in the media transport device, the vacuum suction being communicated from a vacuum source to the holes via a vacuum plenum. The method further comprises controlling an airflow control system to selectively block airflow through upstream and downstream sides of the printhead opening by selectively actuating upstream and downstream valves between open and closed states, upstream and downstream being defined based on the process direction. The upstream valve blocks airflow through the upstream side of the printhead opening in the closed state and allows airflow through the upstream side of the printhead opening in the open state. The downstream valve blocks airflow through a downstream side of the printhead opening in the closed state and allows airflow through the downstream side of the printhead opening in the open state. The method may also comprise controlling the airflow control system to selectively place individual ones of a plurality of channels in on and off states, each of the channels being associated with at least one column of the holes extending in the process direction. Each channel, when in the on state, supplies vacuum suction to the associated column of holes, and each channel, when in the off state, does not supply vacuum suction to the associated column of holes.

BRIEF DESCRIPTION OF THE DRAWINGS

The present disclosure can be understood from the following detailed description, either alone or together with the accompanying drawings. The drawings are included to provide a further understanding of the present disclosure and are incorporated in and constitute a part of this specification. The drawings illustrate one or more embodiments of the present teachings and together with the description explain certain principles and operation. In the drawings.

DETAILED DESCRIPTION

Figure 1A:
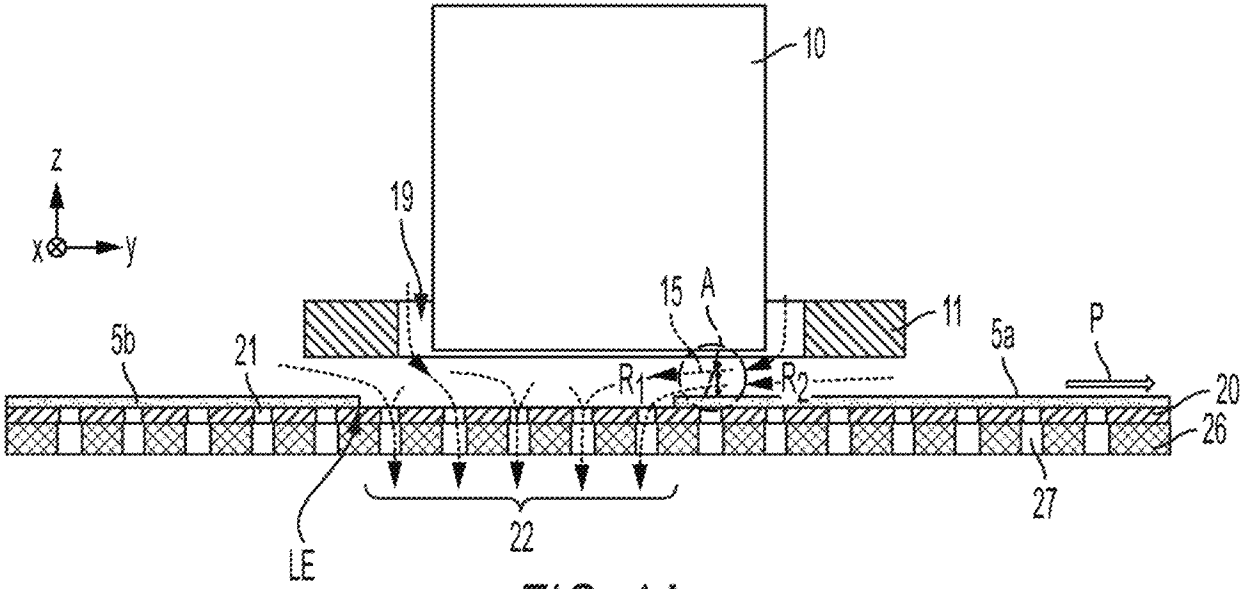
FIG. 1A RELATED ART
FIGS. 1A-1L schematically illustrate air flow patterns relative to a printhead assembly, transport device, and print media during differing stages of print media transport through an ink deposition region of a conventional inkjet printing system, and resulting blur effects in the printed media product.
Figure 1C:
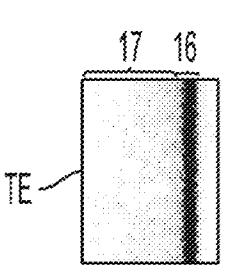

As described above, when an inter-media zone is near or under a printhead, the uncovered holes in the inter-media zone can create crossflows that can blow ink droplets, such as smaller satellite droplets that form upon ejection from a printhead, off course and cause image blur. Similarly, uncovered holes along an inboard or outboard side of the print media can also create crossflows that cause image blur. To better illustrate some of the phenomena giving rise to the blurring issues, reference is made to FIGS. 1A-1L. FIGS. 1A, 1D, 1G, and 1J illustrate schematically printheads 10 printing on a print medium 5 near a trail edge TE, a lead edge LE, an inboard edge IE, and a middle portion, respectively, of the print medium 5. FIGS. 1A, 1D, and 1J are cross-sections taken through one of the printheads 10 along a process direction P (the direction in which the movable surface moves the print media under the printheads through the deposition region, which is in y-axis direction in the figures), while FIG. 1G is a cross-section taken through the same printhead 10 along a cross-process direction perpendicular to the process direction P (the x-axis direction in the figures). FIGS. 1B, 1E, 1H, and 1K illustrate enlarged views of the regions A, B, C, and D respectively in FIGS. 1A, 1D, 1G, and 1J. FIGS. 1C, 1F, 1I and 1L illustrate enlarged pictures of printed images, the printed images comprising lines printed near the trail edge TE, lead edge LE, inboard edge IE, and middle, respectively, of a sheet of paper.

As shown in FIGS. 1A, 1D, 1G, and 1J the inkjet printing system comprises one or more printheads 10 to eject ink to print media 5 through printhead openings 19 in a carrier plate 11, and a movable support surface 20 to transport the print media 5 in a process direction P, which corresponds to a positive y-axis direction in the Figures. The movable support surface 20 moves over (e.g., slides along) a top of a vacuum platen 26, and a vacuum environment is provided on a bottom side of the platen 26. The movable support surface 20 has holes 21 and the vacuum platen 26 has holes 27, and the holes 21 and 27 periodically align as the movable support surface 20 moves so as to expose the region above the movable support surface 20 to the vacuum below the platen 26. In regions where the print medium 5 covers the holes 21, the vacuum suction through the aligned holes 21 and 27 generates a force that holds the print medium 5 against the movable support surface 20. However, little or no air flows through these covered holes 21 and 27 since they are blocked by the print medium 5. On the other hand, as shown in FIGS. 1A, 1D, and 1G in the inter-media zone 22 and in the uncovered region 24 near the inboard side IB of the platen 26, the holes 21 and 27 are not covered by the print media 5, and therefore the vacuum suction pulls air to flow down through these holes 21 and 27. This creates airflows, indicated by the dashed arrows in FIGS. 1A, 1D, and 1G, which flow from regions around the printhead 10 towards the uncovered holes 21 and 27 in the inter-media zone 22 and the uncovered region 24, with some of the airflows passing under the printhead 10.

In FIG. 1A, print medium **5*a* is being printed on near its trail edge TE, and therefore the region where ink is currently being ejected (e.g., ink-ejection region A in FIG. 1A) is located downstream of the inter-media zone 22, the inter-media zone being the region between print medium 5*a* and the print medium 5*b* that follows print medium 5*b*. Upstream and downstream are being defined with respect to the process direction P. Accordingly, some of the air being sucked towards the inter-media zone 22 will flow upstream through the ink-ejection region A. More specifically, the vacuum suction from the inter-media zone 22 lowers the pressure in the region immediately above the inter-media zone 22, e.g., region $R_1$ in FIG. 1A, while the region downstream of the printhead 10, e.g., region $R_2$ in FIG. 1A, remains at a higher pressure. This pressure gradient causes air to flow in an upstream direction from the region $R_2$ to the region $R_1$ with the airflows crossing through the ink-ejection region A in FIG. 1A, which is between the regions $R_1$ and $R_2$. Airflows such as these, which cross through the ink-ejection region, are referred to herein as crossflows 15. In FIG. 1A, the crossflows 15 flow upstream due to the relative location of the inter-media zone 22 with respect to the ink-ejection region A, but when the inter-media zone 22 is located elsewhere, the crossflows 15 may flow differently. In addition, some crossflows may be created due to sources other than the inter-media zone 22, and these crossflows may flow in various directions. Thus the crossflows 15 illustrated are illustrative only and are not meant to be exhaustive of all the crossflows that may be occurring near the printhead 10**.

Figure 1B:
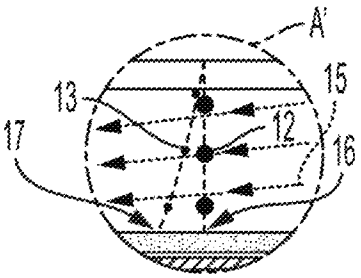
Figure 1D:
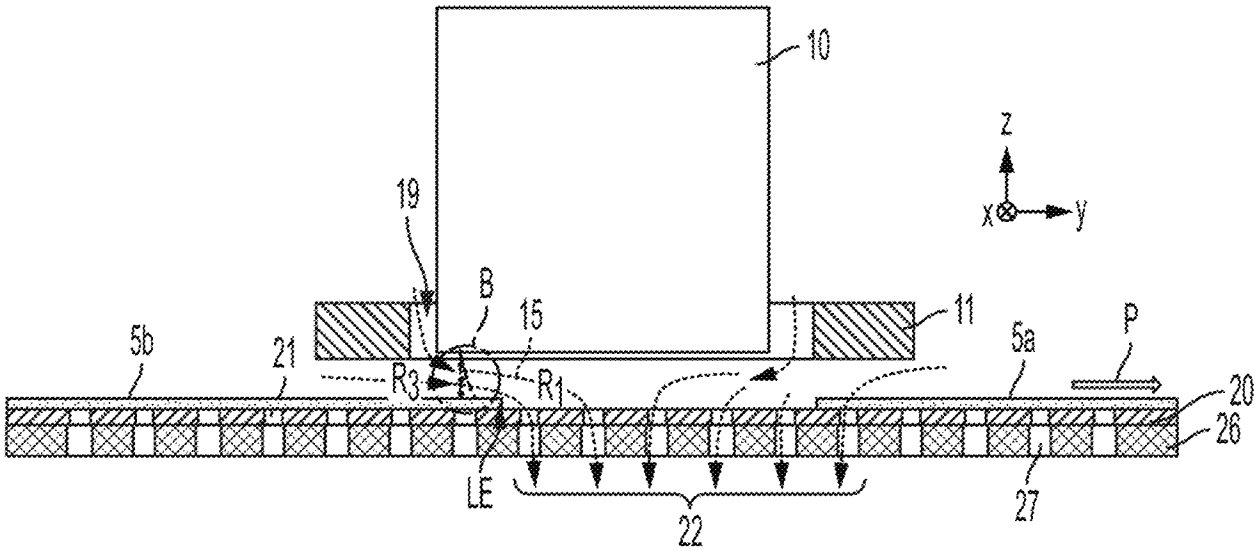
FIG. 1D RELATED ART

As shown in the enlarged view A' in FIG. 1B, which comprises an enlarged view of the region A, as ink is ejected from the printhead 10 towards the medium 5, main droplets 12 and satellite droplets 13 are formed. The satellite droplets 13 are much smaller than the main droplets 12 and have less mass and momentum, and thus the upstream crossflows 15 tend to affect the satellite droplets 13 more than the main droplets 12. Thus, while the main droplets 12 may land on the print medium 5 near their intended deposition location 16 regardless of the crossflows 15, the crossflows 15 may push the satellite droplets 13 away from the intended trajectory so that they land at an unintended location 17 on the medium 5, the unintended location 17 being displaced from the intended location 16. This can be seen in an actual printed image, such as that illustrated in FIG. 1C, in which the denser/darker line-shaped portion is formed by the main droplets 12 which were deposited predominantly at their intended locations 16, whereas the smaller dots dispersed away from the line are formed by satellite droplets 13 which were blown away from the intended locations 16 to land in unintended locations 17, resulting in a blurred or smudged appearance for the printed line. Notably, the blurring in FIG. 1C is asymmetrically biased toward the trail edge TE, due to the crossflows 15 near the trail edge TE blowing primarily in an upstream direction. The inter-media zone 22 may also induce other airflows flowing in other directions, such as downstream airflows from an upstream side of the printhead 10, but these other airflows do not pass through the ink-ejection region A in the illustrated scenario of FIGS. 1A and 1B and thus do not contribute to image blur. Only those airflows that cross through the ink-ejection region are referred to herein as crossflows.

Figure 1F:
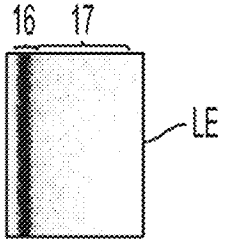
Figure 1E:
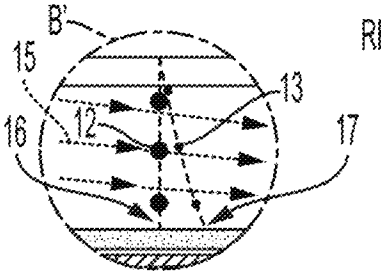
Figure 1G:
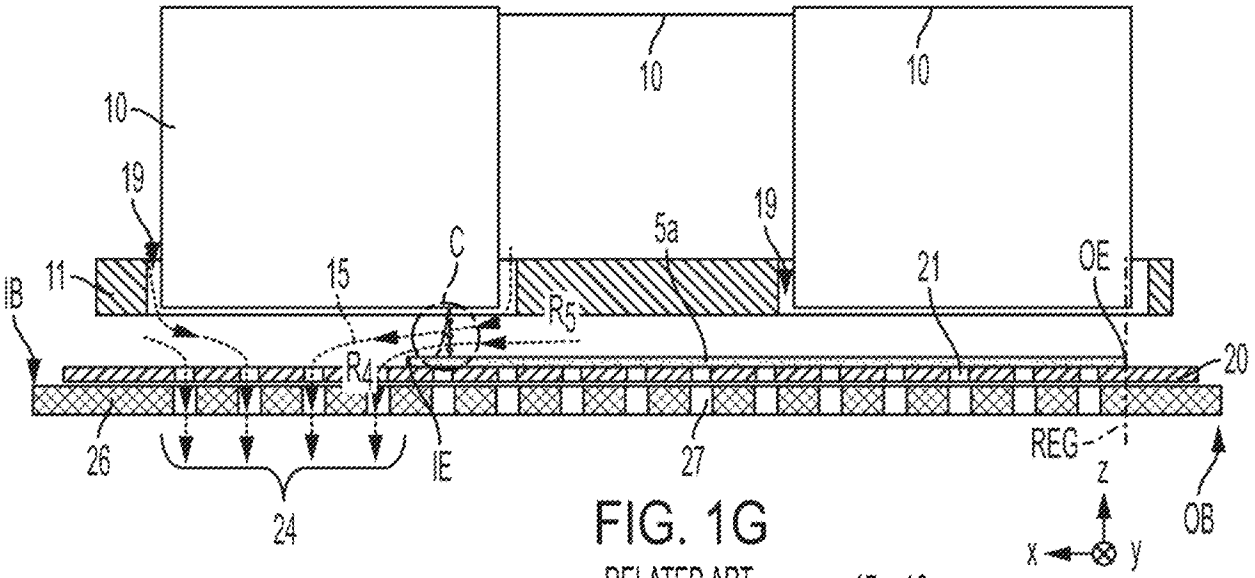
FIG. 1G RELATED ART

FIGS. 1D-1F illustrate a further circumstance of such blurring occurring, but this time near the lead edge LE of the print medium **5*b*. The cause of blurring near the lead edge LE is similar to that described above in relation to the trail edge TE, except that in the case of printing near the lead edge LE the ink-ejection region B is now located upstream of the inter-media zone 22. As a result, the crossflows 15 that are crossing through the ink-ejection region B originate from the upstream side of the printhead 10, e.g., from region $R_3$, and flow downstream. Thus, as shown in the enlarged view B' of FIG. 1E, which comprises an enlarged view of the region B, in the case of printing near the lead edge LE, the satellite droplets 13 are blown downstream towards the lead edge LE of the print medium 5*b* (positive y-axis direction). As shown in FIG. 1F**, this results in asymmetric blurring that is biased towards the lead edge LE.

Figure 1I:
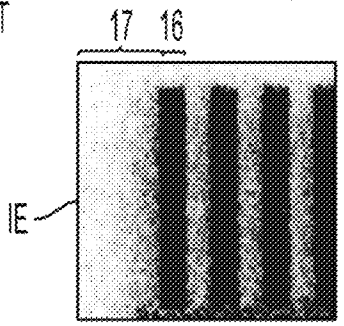
Figure 1H:
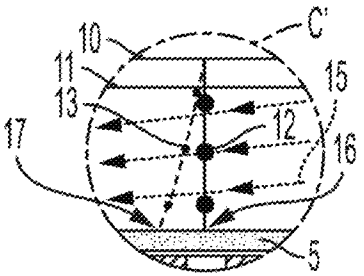
Figure 1J:
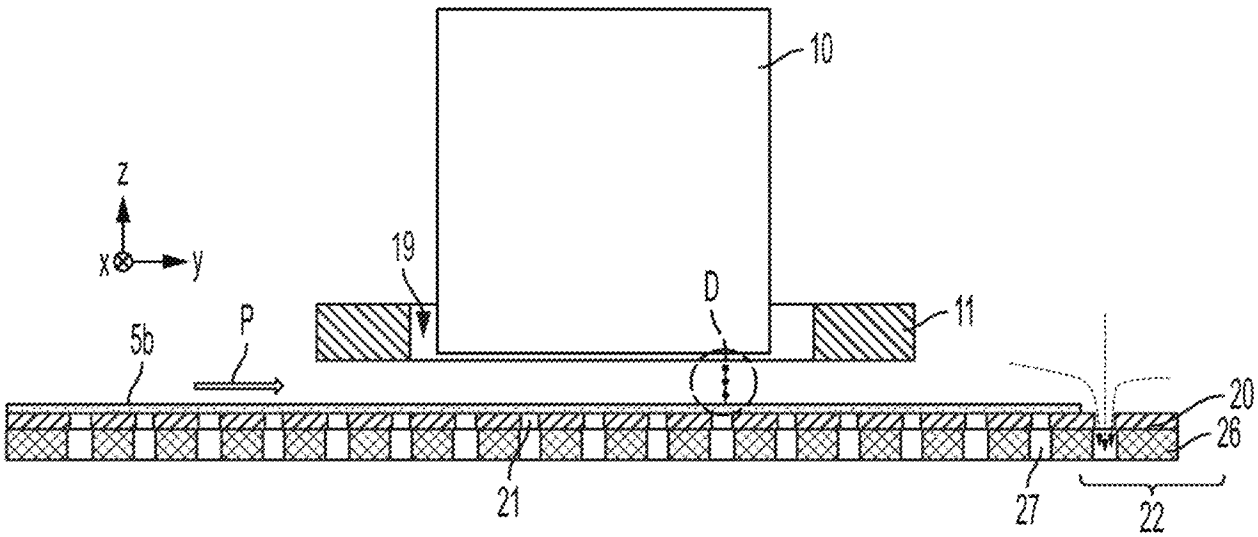
FIG. 1J RELATED ART

FIGS. 1G-1I illustrate another situation in which such blurring can occur, but this time near the inboard edge IE of the print medium **5*a*. As noted above, the inboard edge, as used herein, is whichever edge of the print medium is opposite from the outboard edge, the outboard edge being the edge that is used to register the print media in the cross-process direction. As shown in FIG. 1G, the outboard edge OE is registered to (aligned with) the registration datum (REG). Because the print medium 5*a* is smaller in the cross-process direction than a largest size accommodated by the movable support surface 20, holes 21 along the inboard edge IE of the print media are uncovered. The region along the inboard edge IE containing uncovered holes is referred to herein as an uncovered region 24. The cause of blurring near the inboard edge IE is similar to that described above in relation to the trail edge TE and lead edge LE, except that in the case of printing near the inboard edge IE crossflows 15 are being induced by the uncovered region 24 rather than the inter-media zone 22, and the ink-ejection region is located outboard of the uncovered region 24. As a result, the crossflows 15 that are crossing through the ink-ejection region C now originate from the outboard side of the printhead 10, e.g., from region $R_5$, and flow in an inboard direction towards the region $R_4$. Thus, as shown in the enlarged view C' of FIG. 1H, which comprises an enlarged view of the region C, in the case of printing near the inboard edge IE, the satellite droplets 13 are blown inboard towards the inboard edge IE of the print medium 5***a* (positive y-axis direction). As shown in FIG. 1I, this results in asymmetric blurring that is biased towards the inboard edge IE.

Figure 1L:
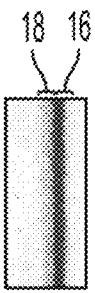
Figure 1K:
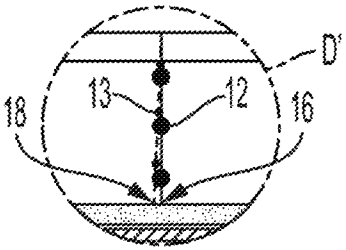

In contrast, as shown in FIGS. 1J and the enlarged view D' in FIG. 1K, which corresponds to an enlarged view of region D, when printing farther from the edges of the print media 105 there may be little or no crossflows 15 because the inter-media zone 22 and the uncovered region 24 are too distant to induce much airflow. Because the crossflows 15 are absent or weak farther away from the edges of the print medium 5 that are near uncovered holes in the movable support surface 20, the satellite droplets 13 in this region are not as likely to be blown off course. Thus, as shown in FIG. 1K and 1L, when printing farther from the edges of the print medium 5*b*, in a "middle portion" of the print medium 5*b*, the satellite droplets 13 tend to land at locations 18 that are much closer to the intended locations 16 resulting in much less, if any, noticeable image blurring. The deposition locations 18 of the satellite droplets 13 may still vary somewhat from the intended locations 16, due to other factors affecting the satellite droplets 13, but the deviation is smaller than it would be near the lead, trail, or inboard edges.

Embodiments disclosed herein may, among other things, reduce or eliminate such image blur by utilizing an airflow control system that reduces or eliminates undesired crossflows tending to result in unacceptable image blur. With the crossflows reduced or eliminated, the satellite droplets are more likely to land closer to or at their intended deposition locations, and therefore the amount of blur is reduced. Airflow control systems in accordance with various embodiments reduce or eliminate the crossflows by selectively blocking airflow through upstream and downstream portions of the printhead openings in carrier plates based on the position of an inter-media zone and/or by selectively blocking airflow through individually addressable channels running along the process direction in the vacuum platen.

In various embodiments, valves are provided relative to each printhead to selectively block the gaps between the printhead and the rim of the printhead opening in the carrier plate. An upstream valve is provided on an upstream side of the printhead to block an upstream gap between the printhead and the rim of the printhead opening, and a downstream valve is provided on a downstream side of the printhead to block a downstream gap between the printhead and the rim of the printhead opening (upstream and downstream defined based on the process direction). Each valve is movable between an open state in which it allows airflow through the gap and a closed state in which it blocks airflow through the gap, at timings that depend on the location of the inter-media zone. In various embodiments, the valves are actively controlled, e.g., actuated by an actuator to move between the open and closed states. In various other embodiments, the valves are passively controlled, e.g., caused to move between the open and closed states by the suction of the inter-media zone as it near the valve.

In various embodiments, the valves are moved between the open and closed states based on location of the inter-media zone such that the valves block airflow through whichever side of the printhead opening in the carrier plate that would tend to contribute to crossflows under the current operating circumstances, while allowing air to flow through the other side of the printhead opening to relieve the low pressure above the inter-media zone. The side of the printhead opening that tends to contribute to crossflows at respective lead and trail edges changes as the inter-media zone moves past the printhead, and therefore the upstream and downstream valves alternate opening and closing based on the position of the inter-media zone as the inter-media zone moves past them. For example, when the downstream edge of the inter-media zone (i.e., the trail edge TE of a print medium) is under a printhead, such as in FIG. 1A, airflow through the downstream side of the corresponding carrier plate opening will tend to contribute to crossflows, as this airflow will tend to flow upstream through the ink-ejection region. On the other hand, in this same situation airflow through the upstream side of the printhead opening will actually help to alleviate crossflows because it will help to counteract the negative pressure above the inter-media zone. Thus, to prevent the crossflows from the downstream side of the printhead opening while allowing the beneficial airflow through the upstream side of the printhead opening, the downstream valve is placed in the closed state and the upstream valve is placed in the open state. As the inter-media zone continues to move downstream, eventually an upstream edge of the inter-media zone (i.e., a lead edge LE of the subsequent print medium) will start to pass under the printhead, such as in FIG. 1D, and at this point the upstream side of the printhead opening becomes the side that contributes to crossflows, while airflow through the downstream side becomes beneficial. Accordingly, the downstream valve changes to the open state and the upstream valve changes to the closed state. Thus, the valves reduce or eliminate crossflows by blocking airflows from one side of the printhead that would otherwise contribute to crossflows while also allowing airflows from the other side of the printhead that help to mitigate crossflows. With the crossflows induced by the inter-media zone reduced or eliminated, the satellite droplets are more likely to land at or nearer to their intended deposition locations near the lead edge and trail edge of the print media, and therefore the amount of blur is reduced.

In various embodiments, the present disclosure further contemplates the use of individually addressable channels provided in the vacuum platen of the media transport device, with the channels extending in a process direction. The channels may be provided at least in an area on the inboard side of the vacuum platen so as to be aligned with potential uncovered regions of the movable support surface that may appear depending on the size of the print media. Each channel communicates the vacuum suction of the vacuum plenum to a corresponding column of the platen holes in the vacuum platen. One or more valves are provided for each channel to block airflow through the corresponding channel (also referred to herein for ease of reference as turning the channel off) or allow airflow through the corresponding channel (also referred to herein for ease of reference as turning the channel on). Accordingly, the suction through individual columns of holes may be turned on or off independently by actuating the valve of the corresponding channel. In various embodiments, the individually addressable channels are controlled based on the size of the print media currently being used such that each channel that is in located in the uncovered region is turned off, thus preventing suction through each of the uncovered platen holes in the uncovered region. With suction blocked in the uncovered region, the cross-flows that would otherwise be caused by the uncovered region are reduced or eliminated and therefore the amount of blur is reduced.

Figure 2:
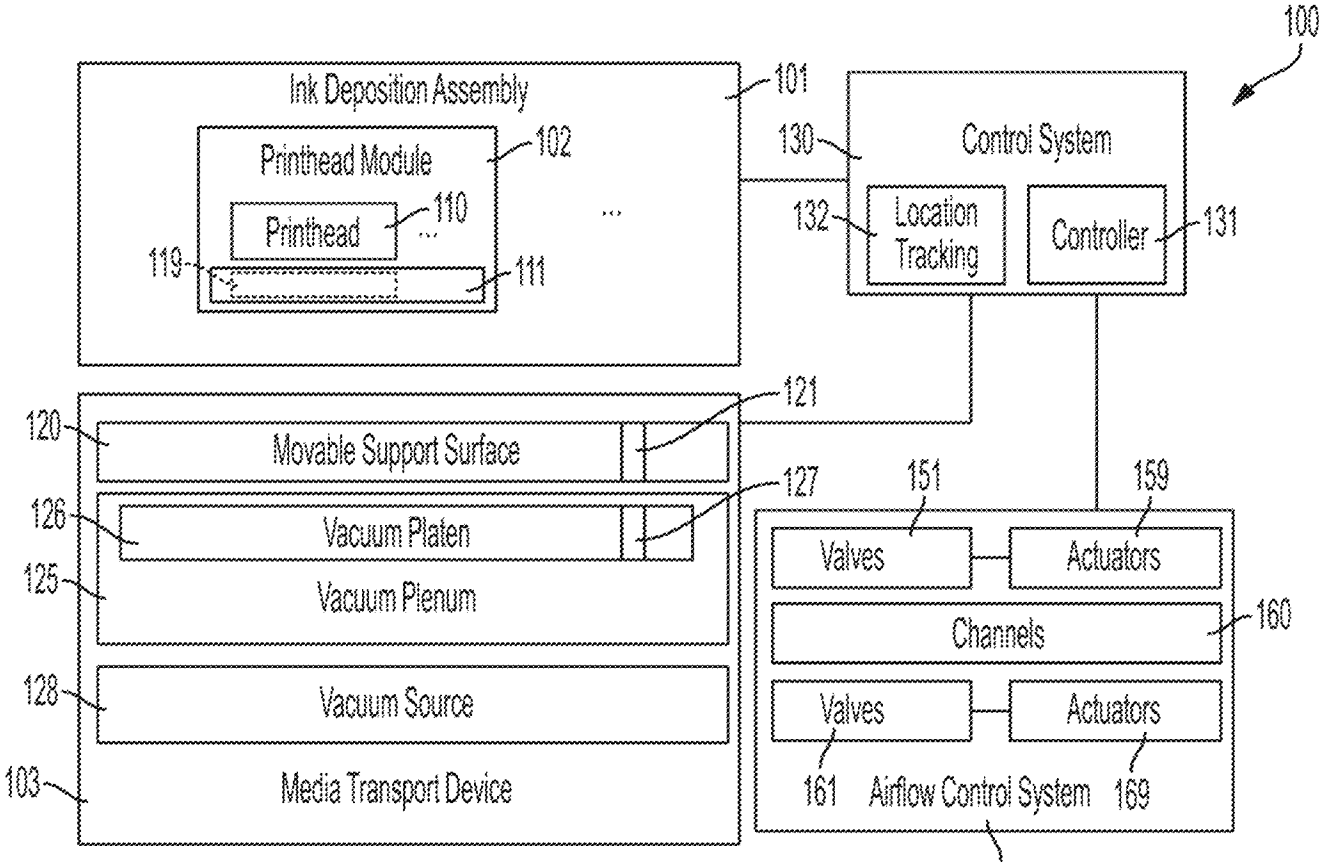
FIG. 2 is a block diagram illustrating components of an embodiment of an inkjet printing system including an air flow control system.

FIG. 2 is a block diagram schematically illustrating a printing system 100 utilizing an airflow control system according to one or more embodiments of the present disclosure. The printing system 100 comprises an ink deposition assembly 101, a media transport device 103, an airflow control system 150, and a control system 130. These components of the printing system 100 are described in greater detail in turn below.

The ink deposition assembly 101 comprises one or more printhead modules 102. One printhead module 102 is illustrated in FIG. 2 for simplicity, but any number of printhead modules 102 may be included in the ink deposition assembly 101. In some embodiments, each printhead module 102 may correspond to a specific ink color, such as, for example, cyan, magenta, yellow, and black. Each printhead module 102 comprises one or more printheads 110 configured to eject print fluid, such as ink, onto the print media to form an image. In FIG. 2, one printhead 110 is illustrated in the printhead module 102 for simplicity, but any number of printheads 110 may be included per printhead module 102. The printhead modules 102 may comprise one or more walls, including a bottom wall which may be referred to herein as a carrier plate 111. The carrier plate 111 comprises printhead openings 119, and the printheads 110 are arranged to eject their ink through the printhead openings 119. In some embodiments, the carrier plate 111 supports the printheads 110. In other embodiments, the printheads 110 are supported by other structures. The printhead modules 102 may also include additional structures and devices to support and facilitate operation of the printheads 110, such as, ink supply lines, ink reservoirs, electrical connections (not shown), and so on, as known in the art.

As shown in FIG. 2, the media transport device 103 comprises a movable support surface 120, a vacuum plenum 125, and a vacuum source 128. The movable support surface 120 transports the print media through a deposition region of the ink deposition assembly 101. The vacuum plenum 125 supplies vacuum suction to one side of the movable support surface 120 (e.g., a bottom side), and print media is supported on an opposite side of the movable support surface 120 (e.g., a top side). Holes 121 through the movable support surface 120 communicate the vacuum suction through the surface 120, such that the vacuum suction holds down the print media against the surface 120. The movable support surface 120 is movable relative to the ink deposition assembly 101, and thus the print media held against the movable support surface 120 is transported relative to the ink deposition assembly 101 as the movable support surface 120 moves. Specifically, the movable support surface 120 transports the print media through a deposition region of the ink deposition assembly 101, the deposition region being a region in which print fluid (e.g., ink) is ejected onto the print media, such as a region under the printhead(s) 110. The movable support surface 120 can comprise any structure capable of being driven to move relative to the ink deposition assembly 101 and which has holes 121 to allow the vacuum suction to hold down the print media, such as a belt, a drum, etc. The vacuum plenum 125 comprises valves, walls, or any other structures arranged to enclose or define an environment in which a vacuum state (e.g., low pressure state) is maintained by the vacuum source 128, with the plenum 125 fluidically coupling the vacuum source 128 to the movable support surface 120 such that the movable support surface 120 is exposed to the vacuum state within the vacuum plenum 125. In some embodiments, the movable support surface 120 is supported by a vacuum platen 126, which may be a top wall of the vacuum plenum 125. In such an embodiment, the movable support surface 120 is fluidically coupled to the vacuum in the plenum 125 via holes 127 through the vacuum platen 126. In some embodiments, the movable support surface 120 is itself one of the walls of the vacuum plenum 125 and thus is exposed directly to the vacuum in the plenum 125. The vacuum source 128 may be any device configured to remove air from the plenum 125 to create the low-pressure state in the plenum 125, such as a fan, a pump, etc.

The airflow control system 150 comprises: (a) valves 151 for controlling airflow around the printheads 110, (b) channels 160 and channel valves 161 for controlling airflow through columns of holes 127 in the vacuum platen 126, or (c) both the valves 151 and the channels 160 and channel valves 161. In some embodiments in which the valves 151 are used, actuators 159 are also provided to move the valves 151 between open and closed states. Herein, moving a valve (such as the valves 151) between open and closed states may be referred to generally as actuating the valve, moving a valve specifically from the open state to the closed state may be referred to as closing the valve, and moving the valve specifically from the closed state to the open state may be referred to as opening the valve. In some embodiments in which the channel valves 161 are provided, actuators 169 are also provided to actuate the channel valves 161. For ease of illustration, in FIG. 2 and in the description below, the airflow control system 150 is shown/described as having both the valves 151 and the channels 160 and channel valves 161, but it should be understood that in some embodiments the valves 151 could be omitted and in other embodiments the channels 160 and channel valves 161 could be omitted.

Each valve 151 is associated with one or more printheads 110, with one valve 151 arranged adjacent an upstream face of each printhead 110 and another valve 151 arranged adjacent a downstream face of each printhead 110. The valves 151 are arranged to block airflow through the gap between an upstream or downstream face of the printhead 110 and the rim of the corresponding printhead opening 119 in the carrier plate 111. Each valve 151 is independently movable between an open state and a closed state, as described above. In the closed state, the valve 151 extends across or over the associated gap between the printhead 110 and the rim of the printhead opening 119 so as to block airflow through the gap. In the open state, the valve 151 is rotated such that it no longer blocks airflow through the gap. Valves 151 that are positioned on an upstream side of a printhead 110 to block airflow through an upstream gap between the printhead 110 and rim of the printhead opening 119 are referred to herein as upstream valves 151 when it desired to highlight their positioning, while valves 151 that are positioned on a downstream side of a printhead 110 to block a downstream gap are referred to herein as downstream valves 151 when it desired to highlight their positioning. When their position is not being highlighted, the upstream and downstream valves are referred to as simply valves.

As mentioned above, in some embodiments, the airflow control system 150 comprises actuators 159 to actively actuate the valves 151. Each actuator 159 is a device configured to drive movement of the valve 151 between the open and closed states. The actuator 159 can be of a variety of types, including but not limited to, for example, a hydraulic or pneumatic piston, a solenoid, a linear actuator, a hydraulic or pneumatic rotary actuator, an electric motor, a rotary actuator, etc. The actuator 159 may utilize electrical motive power, hydraulic motive power, pneumatic motive power, or any other desired motive power. The actuator 159 may also comprise various motion/force conversion mechanisms or linkages, such as linear-to-rotary conversion mechanisms, rotary-to-linear conversion mechanisms, or any other linkages to transfer and/or convert motion of the actuator 159 into the desired motion of the valve 151.

In some embodiments, rather than utilizing actuators 159 to actively actuate the valves 151, the valves 151 are passively actuated. For example, the valves 151 may be threshold valves which are configured to automatically transition to the open state when subjected to a pressure differential that exceeds a certain threshold and to automatically transition back to the closed state when the pressure differential drops below the threshold. In such embodiments, the presence of the inter-media zone near the valve 151 creates the pressure differential that actuates the valve 151 to the open state, whereas when the inter-media zone is more distant from the valve 151 the pressure differential drops and the valve 151 automatically returns to the closed state.

Regardless of whether the valves 151 are actively actuated or passively actuated, the airflow control system 150 actuates the valves 151 (i.e., between closed and open states) based on the location of the inter-media zone. The actuation for the valves 151 based on the location of the inter-media zone may be actively controlled via the actuators 159 and a controller 131 (described further below) or it may be passively controlled using threshold valve as noted above. Because the lead edge LE and the trail edge TE of the print media define the boundaries of the inter-media zone , references herein to a location of the inter-media zone are equivalent to referring to corresponding locations of the lead edge LE and trail edge TE of the print media 105. Thus, when it is said herein that the airflow control system 150 actuates the valves 151 based on the location of the inter-media zone , this is equivalent to the airflow control system 150 actuating the valves 151 based on the locations of the lead edge LE and trail edges TE of the print media.

In embodiments in which active actuation of the valves 151 is used, a controller 131 may control the actuators 159 to actuate the valves 151 at timings that correspond to certain positions of the inter-media zone , which may be predetermined positions or dynamically determined positions. The positions may be defined relative to a reference location or object, such as a printhead opening (or part thereof), a printhead 110 (or part thereof), a valve 151 (or part thereof), etc., which may be referred to hereinafter as a trigger location. In general, each downstream valve 151 is controlled such that it is closed at least while the trail edge TE of a print medium (i.e., the downstream edge of the inter-media zone) is located under the printhead 110 associated with the valve 151. Conversely, each upstream valve 151 is controlled such that it is closed at least while the lead edge LE of a print medium (i.e., the upstream edge of the inter-media zone) is under the printhead 110 associated with the valve 151. In embodiments in which there are multiple printheads 110 per printhead module 102 and the printheads 110 are offset in the process direction, in addition to the control noted above, a downstream valve 151*d* may be controlled such that it is closed while the lead edge LE of a print medium is located under a neighboring printhead 110 that is downstream of the printhead 110 associated with the valve 151, and an upstream valve 151 may be controlled such that it is closed while the trail edge TE of a print medium is located under a neighboring printhead 110 that is upstream of the printhead 110 associated with the valve 151.

More specifically, in some embodiments each downstream valve 151 is actuated to the closed state when (or before) the downstream edge of the inter-media zone (i.e., the trail edge TE of a print medium) reaches an upstream trigger location associated with the valve 151. The downstream valve 151 may be actuated to the open state when the downstream edge of the inter-media zone reaches a downstream trigger location associated with the valve 151. Conversely, an upstream valve 151 is actuated to the closed state when the upstream edge of the inter-media zone 122 (i.e., the lead edge LE of a print medium) reaches an upstream trigger location associated with the valve 151 or when the downstream edge of the inter-media zone reaches a downstream trigger location associated with the valve 151. The upstream valve 151 may be actuated to the open state when the downstream edge of the inter-media zone 122 (i.e., the trail edge TE of a print medium) reaches the upstream trigger location associated with the valve 151. The upstream trigger location associated with a valve 151 may be any predetermined location on an upstream side of the deposition region of the printhead 110 associated with the valve 151, such as, for example: an upstream edge of a carrier plate 111, an upstream edge of a printhead opening 119, an upstream edge of the printhead, and an upstream edge of the ink deposition region of the printhead 110. The downstream trigger location may be any predetermined location on a downstream side of the deposition region of the printhead 110 associated with the valve 151, such as, for example: a downstream edge of the ink deposition region of the printhead 110, a downstream edge of the printhead 110, and a downstream edge of the printhead opening 119. The precise timings at which the valves 151 are transitioned between the open and closed states may depend on factors such as: the speed of actuation of the actuator 159, the width of the inter-media zone (i.e., the gap distance between adjacent print media), the speed of the movable support surface 120, and so on. Positioning and actuation of the valves in accordance with embodiments are discussed in greater detail below in relation to FIGS. 4A-9.

The airflow control system 150 may comprise independently addressable channels 160 (channels 160). The channels 160 each correspond to one or more columns of holes 127 in the platen 126, with the channels and the columns of holes 127 extending in the process direction. The channels 160 comprise structures that define a passageway through which the vacuum suction of the vacuum plenum 125 is communicated to the corresponding holes 127. The channel valves 161 are respectively coupled with the channels 160 to control airflow through the channels 160. When a channel valve 161 is open, airflow is allowed through the corresponding channel 160, and thus vacuum suction through the corresponding holes 127 is enabled. This state is referred to herein as the channel 160 being on. When a channel valve 161 is closed, airflow through the channel 160 is stopped, and thus vacuum suction through the corresponding holes 127 is stopped. This state is referred to herein as the channel 160 being off. The actuators 169 are operably coupled to the channel valves 161 to move them between the open and closed states.

In some embodiments, the channels 160 are provided for each column of holes 127 in the platen 126. In other embodiments, the channels are provided for just a subset of the columns. When the channels 160 are provided for less than all of the holes 127, the channels 160 may be provided for columns of holes 127 that are located along the inboard side of the vacuum platen 126, as this is the region that is more likely to become uncovered when smaller width (measured in cross-process direction) print media are used. As noted above, in printing systems such as the printing system 100, an outboard edge OE of the print media are registered to a registration datum (e.g., REG in FIG. 1G) that is located on an outboard side (e.g., OB in FIG. 1G) of the media transport device, and therefore when smaller print media are used holes that are inboard of the inboard edge are uncovered.

Although the description herein assumes that the outboard edge of the print media is registered, other registration schemes could be used. For example, the print media could be centered on the platen 126, in which case uncovered regions might appear on along both edges of the print media. The inboard edge system is shown and described for ease of understanding, but the location of the channels 160 could be adjusted if other registration schemes are used so as to align with wherever the uncovered regions potentially appear, and the principles of operation would be same no matter which portion of the platen 126 has the uncovered region.

The channel valves 161 are independently actuated to control which channels 160 are turned off and which are left on. The airflow control system 150 may select which channels 160 to turn off based on the size of the print media that are currently being used (e.g., selected for a print job or currently being printed on). In particular, any channels 160 fluidically coupled to corresponding holes 127 that are not (or will not be) covered by the print media are turned off, while any channels 160 fluidically coupled to corresponding holes 127 that are (or will be) covered by print media are left on. Thus, all of the channels 160 that are fluidically coupled with holes 127 in the uncovered region 24 are turned off, preventing suction through the holes 127 in the uncovered region 24 and eliminating crossflows induced by the uncovered region 24. Moreover, all of the holes 127 that are covered by the print media are allowed to receive the vacuum suction, and thus the suction hold down force on the print media is maintained at full force. If the size of the print media being used changes, then the airflow control system 150 changes which channels 160 are turned off based on the size of the new print media.

Referring again to FIG. 2, The control system 130 comprises processing circuitry to control operations of the printing system 100. The processing circuitry may include one or more electronic circuits configured with logic for performing the various operations described herein. The electronic circuits may be configured with logic to perform the operations by virtue of including dedicated hardware configured to perform various operations, by virtue of including software instructions executable by the circuitry to perform various operations, or any combination thereof. In examples in which the logic comprises software instructions, the electronic circuits of the processing circuitry include a memory device that stores the software and a processor comprising one or more processing devices capable of executing the instructions, such as, for example, a processor, a processor core, a central processing unit (CPU), a controller, a microcontroller, a system-on-chip (SoC), a digital signal processor (DSP), a graphics processing unit (GPU), etc. In examples in which the logic of the processing circuitry comprises dedicated hardware, in addition to or in lieu of the processor, the dedicated hardware may include any electronic device that is configured to perform specific operations, such as an Application Specific Integrated Circuit (ASIC), a Field Programmable Gate Array (FPGA), a Complex Programmable Logic Device (CPLD), discrete logic circuits, a hardware accelerator, a hardware encoder, etc. The processing circuitry may also include any combination of dedicated hardware and general-purpose processor with software. In some embodiments, the logic of the control system 130 may include logic corresponding to a location tracking system 132 and logic corresponding to a controller 131, which described more below.

As noted above, the controller 131 is configured to determine when to actuate the valves 151. The controller 131 generates signals to control the actuators 159 to cause the actuators 159 to move the valves 151 at the determined timings. The controller 131 may be part of the control system 130 and comprises one or more electronic circuits configured with logic to perform operations described herein, as described above in relation to the control system 130. Although illustrated as part of the control system 130, the controller 131 may also be considered as part of the airflow control system 150 because it controls some operations of the airflow control system 150. Certain operations described herein as being performed by the airflow control system 150 may be performed by the controller 131. The physical location of the hardware forming the controller 131 is not limited.

The location tracking system 132 may be used to track the locations of the inter-media zones and/or print media as the print media are transported through the ink deposition assembly. As used herein, tracking the location of the inter-media zones or the print media refers to the system having knowledge, whether direct or inferred, of where the print media are located at various points as they are transported through the ink deposition assembly 101. Direct knowledge of the locations of the inter-media zones or print media may comprise information obtained by directly observing the print media, for example via one or more sensors (e.g., an edge detection sensor). Inferred knowledge of the locations of the inter-media zones or print media may be obtained by inference from other known information, for example by calculating how far a print medium would have moved from a previously known location based on a known speed of the movable support surface 120. In some embodiments, the location tracking system 132 may explicitly track locations of the inter-media zones , the lead edges LE of print media, and/or the trail edges TE of print media. In other embodiments, the location tracking system may explicitly track the locations of some other part(s) of the print medium. Because the locations of the inter-media zones depend deterministically on the locations of the print media and on the dimensions of the print media (which are known to the controller), tracking the locations of some arbitrary part of the print media is functionally equivalent to tracking the locations of the inter-media zones. In some embodiments, the location tracking system 132 may be part of the control system 130.

Most existing printing systems are already configured to track the locations of the print media as they are transported through the ink deposition assembly, as knowledge of the locations of the print media may be helpful to ensure accurate image formation on the print media. Thus, various systems for tracking the locations of print media are well known in the art. Because such location tracking systems are well known, they will not be described in detail herein. Any known location tracking system (or any new location tracking system) may be used in the embodiments disclosed herein to track the location of print media, and a controller may use this information to determine the locations of the lead edge LE and/or the trail edge TE (if not already known).

Turning now to FIGS. 3-8C, specific embodiments of printing systems will be described, which can be used as the printing system 100. In the Figures and the description below, indexes such as "_1", "_2", etc. are appended to the end of the reference numbers of some components. These indexes are used when a plurality of similar components are present and it is desired to refer to a specific one of those components. However, when the components are being referred to generally or collectively without a need to distinguish between specific ones, the index may be omitted. Thus, as one example, a valve 351 may be labeled and referred to as a first valve 351_1 when it is desired to identify a specific one of the valves 351, as in FIG. 4A but it may also be labeled and referred to as simply a valve 351 in other cases in which it is not desired to distinguish between multiple valves 351. Similarly, for some components a "u" or "d" are appended to a reference numeral to indicate a relative upstream or downstream position with respect to a corresponding printhead, with upstream and downstream being relative to the process direction as noted above.

Figure 3:
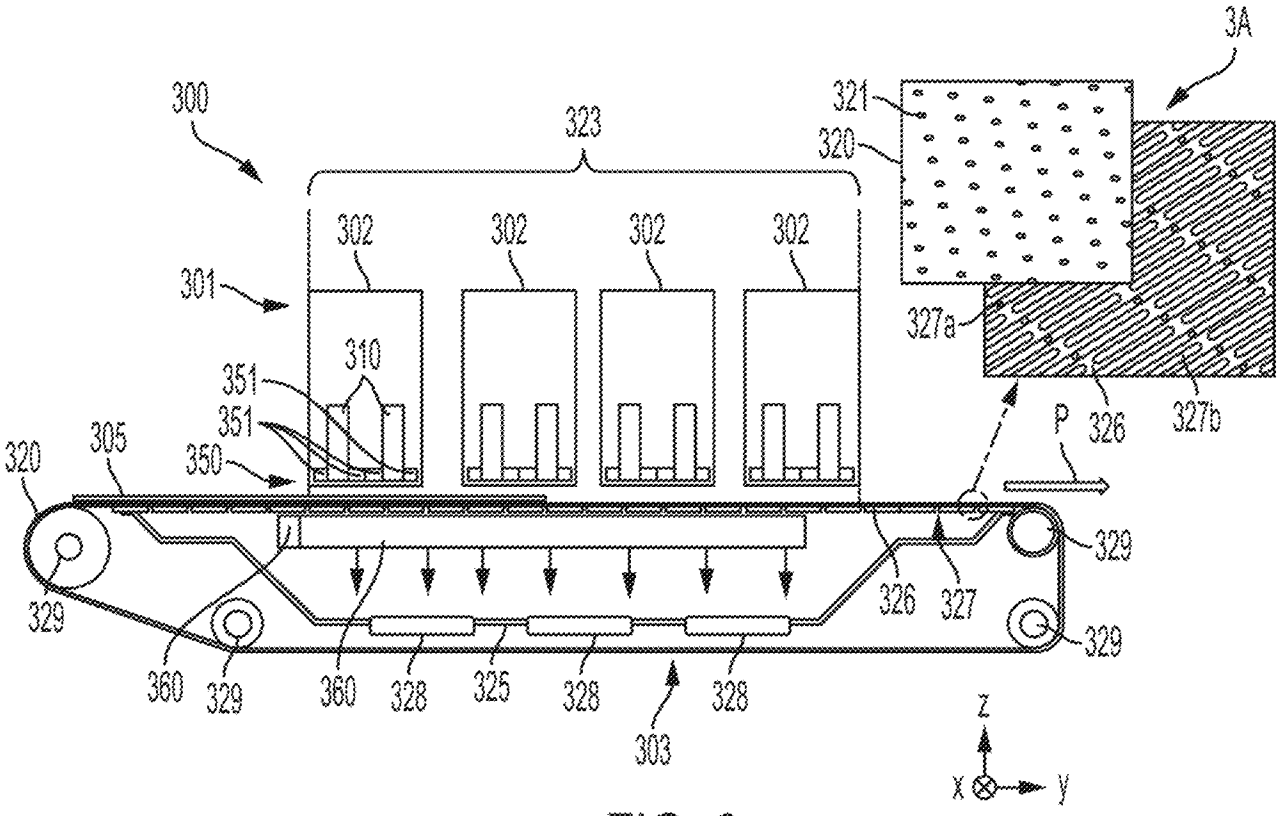
FIG. 3 is a schematic illustration of an ink deposition assembly, media transport device, and air flow control air flow control system of one embodiment of an inkjet printing system.

FIGS. 3-5F illustrate a printing system 300, which may be used as the printing system 100 described above with reference to FIG. 2. FIG. 3 comprises a schematic illustration of a portion of the printing system 300 from a side view. FIG. 4A comprises a plan view taken looking down onto the printhead modules 302 and media transport device 303. In FIG. 4A, some components that would not otherwise be visible in the view because they are positioned below other components are illustrated with dashed or dotted lines. FIGS. 5A-5F comprise cross-sections of the printing system 300 with the section taken along D in FIG. 4A, with each of FIGS. 5A-5F showing a sequence of states as print media 305*a* and 305*b* are transported past one of the printhead modules 302.

As illustrated in FIG. 3, the printing system 300 comprises an ink deposition assembly 301, a media transport device 303, and an airflow control system 350, which can be used as the ink deposition assembly 101, media transport device 103, and airflow control system 150, respectively, of FIG. 2. The printing system 300 may also comprise additional components not illustrated in FIGS. 3-5F, such as a control system (e.g., the control system 130).

Figure 4A:
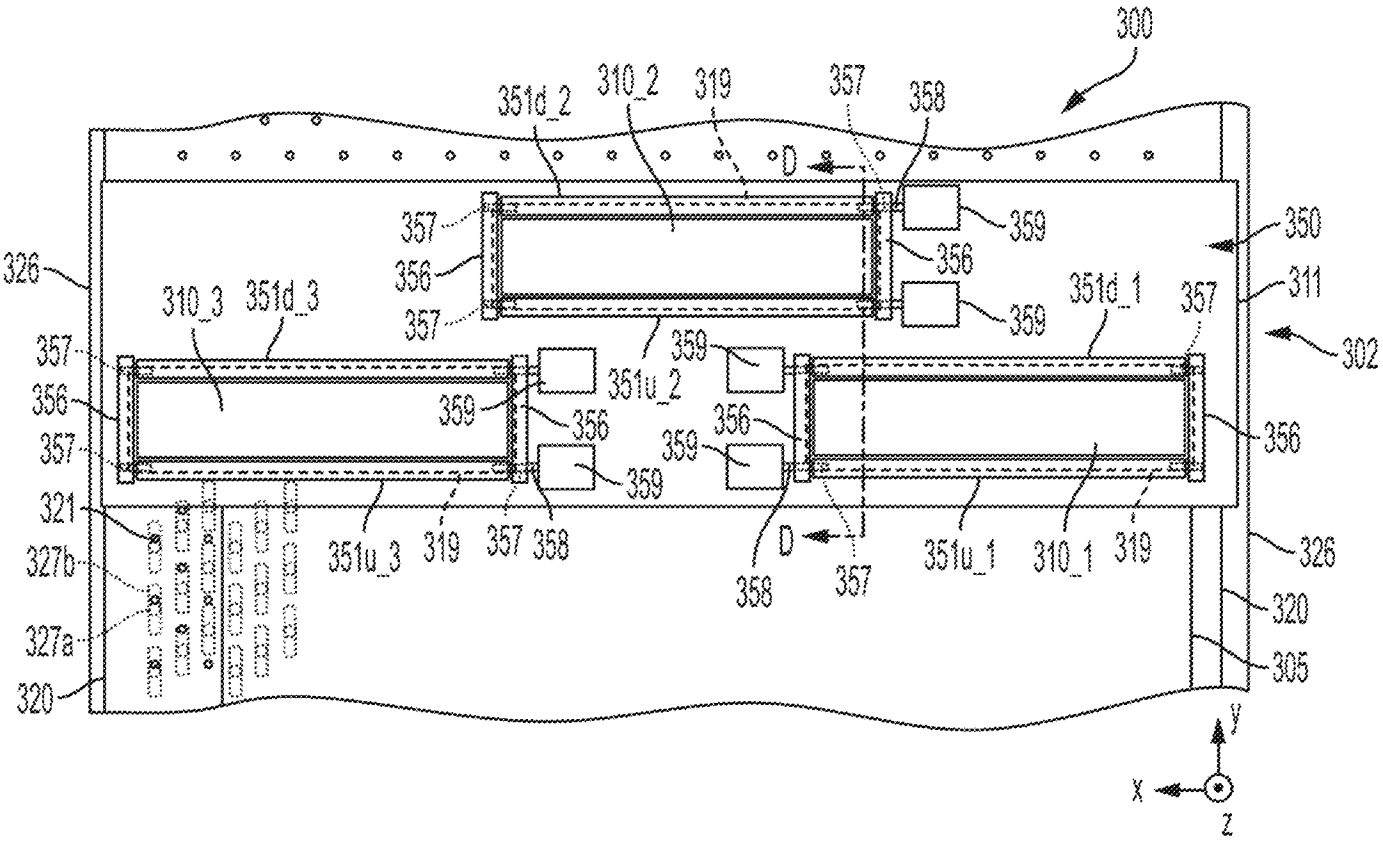
FIG. 4A is a plan view from above the printhead assembly of the inkjet printing system of FIG. 3.

In the printing system 300 shown in FIG. 3, the ink deposition assembly 301 comprises four printhead modules 302, with each module 302 having three printheads 310 as shown in FIG. 4A. As shown in FIG. 3, the printhead models 302 are arranged in series along a process direction P above the media transport device 303, such that the print media 305 is transported sequentially beneath each of the printhead modules 302. As illustrated in FIG. 4A, the printheads 310 are arranged to eject print fluid (e.g., ink) through respectively corresponding printhead openings 319 in a corresponding carrier plate 311, with a bottom end of the printhead 310 extending down partway into the printhead openings 319. In this embodiment, the printheads 310 are arranged in an offset pattern with one of the printheads 310 being further upstream or downstream than the other two printheads 310 of the same printhead module 302. In other embodiments, different numbers and/or arrangements of printheads 310 and/or printhead modules 302 are used, with those of ordinary skill in the art understanding that a variety of such numbers and arrangements can be selected as desired.

In the printing system 300, media transport device 303 comprises a flexible belt providing the movable support surface 320. As shown in FIG. 3, the movable support surface 320 is driven by rollers 329 to move along a looped path, with a portion of the path passing through the ink deposition region 323 of the ink deposition assembly 301. Furthermore, in this embodiment, the vacuum plenum 325 comprises a vacuum platen 326, which forms a top wall of the plenum 325 and supports the movable support surface 320. The platen 326 comprises platen holes 327, which allow fluidic communication between the interior of the plenum 325 and the underside of the movable support surface 320.

In some embodiments, the platen holes 327 may include channels on a top side thereof, as seen in the expanded cutaway 3A of FIG. 3, which may increase an area of the opening of the holes 327 on the top side thereof. Specifically, the platen holes 327 may include a bottom portion 327*a* which opens to a bottom side of the platen 326 and a top potion 327*b* which opens to a top side of the platen 326, with the top portion 327*b* being differently sized and/or shaped than the bottom portion 327*a*. For example, FIGS. 3-5F illustrate an embodiment of the platen holes 327 in which the top portion 327*b* is a channel elongated in the process direction while the bottom portion 327*an* is a through-hole that is less-elongated and has a smaller sectional area (see the enlargement 3A in FIG. 3 and the dashed-lines in FIG. 4A). In some embodiments, multiple holes 327 may share the same top portion 327*b*, or in other words multiple bottom portions 327*a* may be coupled to the same top portion 327*b*.

The holes 321 of the movable support surface 320 are disposed such that each hole 321 is aligned in the process direction (y-axis) with a collection of corresponding platen holes 327. Thus, as the movable support surface 320 moves over (e.g., slides across) the platen 326, each hole 321 will periodically move over a corresponding platen hole 327, resulting in the hole 321 and the platen hole 327 being temporarily vertically aligned (i.e., aligned in a z-axis direction). When a hole 321 moves over a corresponding platen hole 327, the holes 321 and 327 define an opening that fluidically couples the environment above the movable support surface 320 to the low-pressure state in the vacuum plenum 325, thus generating vacuum suction through the holes 321 and 327. This suction generates a vacuum hold down force on a print medium 305 if the print medium 305 is disposed above the hole 321.

As shown in FIGS. 3-5F, the airflow control system 350 comprises valves 351 and corresponding actuators 359 to actuate the valves 351. The valves 351 and actuators 359 may be used as the valves 151 and actuators 159 described above in relation to FIG. 2. In the printing system 300, there are two valves 351 per printhead 310, including, as depicted in FIGS. 4A-5F, an upstream valve 351*u* to block a portion of the opening 319 on an upstream side of the printhead 310 and a downstream valve 351*d* to block a portion of the opening 319 on a downstream side of the printhead 310. Thus, in FIG. 4A, a first printhead 310_1 has an upstream valve 351*u*_1 and a downstream valve 351*d*_1 a second printhead 310_2 has an upstream valve 351*u*_2 and a downstream valve 351*d*_2, and so on. In FIG. 4A each valve 351 has its own corresponding actuator 359 to actuate the valve 351. In other embodiments, some valves 351 may share the same actuator 359, such as valves 351 which are aligned with one another in the cross-process direction (e.g.,

351*u*_1 and 351*u*_3, and 351*d*_1 and 351*d*_3), and those valves 351 may be actuated simultaneously. In embodiments in which multiple valves 351 share the same actuator 359, the actuator 359 may be coupled to the valves 351 via linkages to transfer motion of the actuator 359 to each of the associated valves 351. In FIG. 4A there are six valves 351 because there are three printheads 310, but in other embodiments in which a different number of printheads 310 are provided, different numbers of valves 351 may be provided such that each printhead 310 has two corresponding valves 351.

Figure 4B:
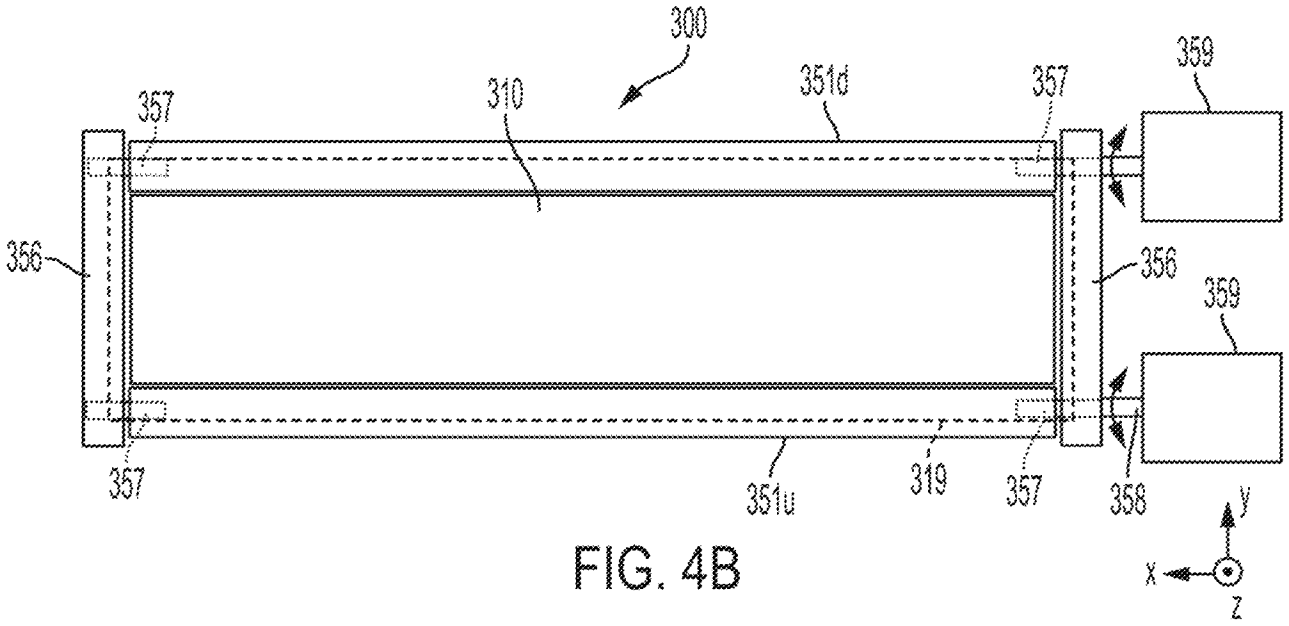
FIG. 4B is a plan view of a portion of inkjet printing system of FIG. 3.
Figure 5A:
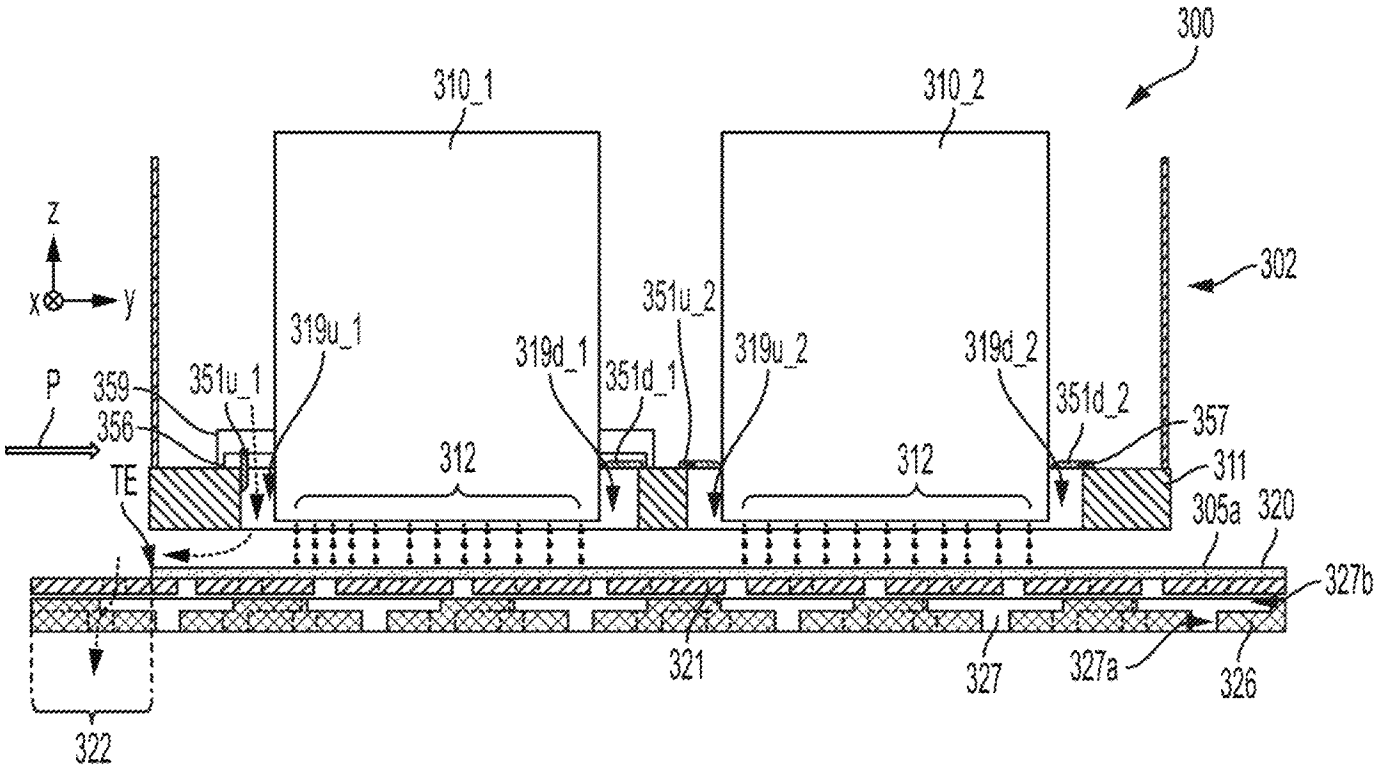
FIGS. 5A-5F are cross-sectional views of the inkjet printing system of FIG. 4A, with the cross-section taken along D in FIG. 4A.

As noted above, the valves 351 are positioned to block airflow through portions of the openings 319 when in a closed state. Specifically, each upstream valve 351*u* is positioned to block airflow through the gap between the upstream side of a printhead 310 and the rim of the opening 319 associated with that printhead 310, this gap being referred to herein as an upstream gap 319*u*. Similarly, each downstream valve 351*d* is positioned to block airflow through the gap between the downstream side of a printhead 310 and the rim of the opening 319, this gap being referred to herein as a downstream gap 319*d*. In the embodiment of FIGS. 3-5F, in the closed state a valve 351 is positioned above the carrier plate 311 and generally parallel to the top of the carrier plate 311 (see FIGS. 4B and 5A), with one end of the valve 351 being against (or close to) the top of the carrier plate 311 (referred to hereinafter as the carrier plate end of the valve 351) and another end of the valve 351 contacting (or coming close to) the side face of the printhead 310 (referred to hereinafter as the printhead end of the valve 351) such that the valve 351 substantially spans the area above the gap 319*u* or 319*d* and blocks airflow through the gap 319*u* or 319*d*. For example, see the valves 351*d*_1, 351*u*_2, and 351*d*_2 in FIG. 5A, which are in the closed state. As best seen in FIGS. 4B and 5A, the valves 351 are pivotably coupled to the carrier plate 311 by pivot couplings 357 and base plates 356. The base plates 356 are fixed relative to the carrier plate 311 and each pivot coupling 357 is rotatably coupled to a base plate 356 and to a corresponding valve 351, thereby enabling rotation (pivoting) of the valve 351 relative to the carrier plate 311. The rotation of the valves 351 may be around an axis of rotation that is parallel to the cross-process direction. In the embodiment of FIG. 5A-5E, the pivot 357 is attached to the corresponding valve such that, as the valve 351 is rotated from the closed state to the open state, the end of the valve 351 near the printhead 310 moves away from the printhead 310 towards the carrier plate 311, thereby opening the gap 319*u* or 319*d*. In the open state the valve 351 is non-parallel to the top of the carrier plate 311, such that air can move past the valve 351 through the gap 319*u* or 319*d*. For example, see the valve 351*u*_1 in FIG. 5A, which is in the open state.

In other embodiments, the valves 351 may be positioned and configured differently. For example, in the closed state the valves 351 may be positioned fully within the gap 319*u* or 319*d*, rather than above the gap 319*u* or 319*d*. As another embodiment, in the open state the printhead end of the valves 351 may be rotated upward away from the gap rather than being rotated downward into the gap 319*u* or 319*d*. As another embodiment, the pivot 357 may be coupled to the valve 351 near the printhead-end of the valve 351 or near the middle of the valve 351, rather than near the carrier-plate end of the valve 351, resulting in a different location and orientation of the valve 351 in the open state.

The valves 351 comprise, for example, solid plate-like structures of one or more materials and may be made of any suitable materials, such as metal, plastic, rubber, polymer, etc. In some embodiments, the valves 351 comprise metal, which provides sturdiness and resistance to wear and tear. In FIG. 4A, the valve 351 is generally rectangular in profile, but the shape of the valve 351 is not limited to this. The valve 351 may have any desired shape as long as the valve 351 can block and unblock the gaps 319*u* or 319*d* as described herein. In some embodiments, the valves 351 comprise pneumatic oscillating valves.

The valves 351 may be driven to rotate between the open and closed states by actuators 359. In FIG. 3, the actuators 359 are rotary actuators that drive rotation of a shaft 358, with rotation of the shaft 358 driving rotation of a corresponding one of the valves 351. In the illustrated embodiment, the shaft 357 is coupled directly to the pivot 357 (or is an integral part of the same piece as the pivot 357) and the pivot 357 is fixedly attached to the valve 351, and therefore rotation of the shaft 358 causes rotation of the pivot 357 which causes rotation of the valve 351. In other embodiments, the actuators 359 may be linear actuators that impart linear movement to a drive output, and the linear motion of the drive output may drive rotation of the valves 351 through a linear to rotary conversion mechanism. For example, a linear actuator may be coupled to the end of the valve 351 that is opposite from the pivot 357 and may be configured to move that end vertically (i.e., Z-axis direction), in which case the pivot 357 may act as a conversion mechanism to convert this linear motion into rotation of the valve 351. Other conversion mechanisms, linkages, and actuators could be used in a variety of configurations to impart rotation to the valves 351, as would be understood by those of ordinary skill in the art. Any device capable of generating motion (rotation or translation) of a drive output may be used as the actuator 359, such as an electrical motor, a hydraulic rotary actuator, a pneumatic rotary actuator, a solenoid, a hydraulic actuator, a pneumatic actuator, an electrical motor etc.

A variety of valves and actuators, including shapes, sizes, materials, and/or movements, are envisioned as being within the scope of the present disclosure, with those having ordinary skill in the art understanding, based on the principles of operation disclosed herein, that any valve can be selected as desired as long as it can move between a state in which it blocks air flow through the gap between the printhead and the carrier plate and a state in which it permits air flow through the gap between the printhead and the carrier plate.

As described above, the airflow control system 350 is configured to actuate the valves 351 at timings based on the position of the inter-media zone 322. As noted above with respect to the valves 151, each valve 351 has an upstream trigger location and a downstream location associated with it, and the valve 351 is moved based on the location of the inter-media zone 322 relative to these trigger locations. The description above related to timings of actuating the valves 151 is applicable to the valves 351. In practice, it takes a finite amount of time for the valve 351 to move between configurations, and during this time while the valve 351 is moving the inter-media zone 322 continues to move. Thus, in some embodiments, to ensure that the valve 351 is in the intended configuration when the inter-media zone 322 reaches a desired trigger location ("nominal trigger location"), the actuator 359 may be controlled to start moving the valve 351 at a time just before the inter-media zone 322 actually reaches the nominal trigger location. In other words, an actual trigger location that is used to trigger the extending or retracting may be offset from the nominal trigger location by some fixed amount to account for the finite amount of time it takes the valve 351 to extend or retract. The known speed of the movable support surface 320 and a known deployment time for the valve 351 may be used to determine the offset.

The operations of the valves 351 and how they reduce crossflows are explained in greater detail below with reference to FIGS. 5A-5F. FIGS. 5A-5F comprise cross sections taken along D in FIG. 4A and illustrate various positions of the inter-media zone 322 and corresponding states of the valves 351. In FIGS. 5A-5F, timings for actuating the upstream valves 351*u*_1 and the downstream valve 351*u*_2 are described, and the same timings may be used for actuating the valves 351*u*_3 and valves 351*d*_3, respectively. Moreover, although the timings for actuating valves 351 of just one printhead module 302 are described, similar timings may be used for actuating similarly situated valves 351 in the other printhead modules 302.

FIG. 5A illustrates the inter-media zone 322 in a first position. The first position corresponds to the downstream edge of the inter-media zone 322 (i.e., the trail edge TE of the print medium 305*a*) reaching an upstream trigger location associated with the first upstream valve 351*u*_1. In this example, the upstream trigger location of the first upstream valve 351*u*_1 is the upstream face of the carrier plate 311, and therefore at or before the timing when the trail edge TE of the print medium 305*a* is at (i.e., vertically aligned with) the upstream edge of the carrier plate 311 the controller causes the corresponding actuator 359 (not shown) to open the valve 351. Thus, in this state the valve 351*u*_1 allows airflow through the upstream gap 319*u*_1. The other valves 351 are in the closed state, and thus they block airflow through their respective gaps 319*u* or 319*d*.

Figure 5B:
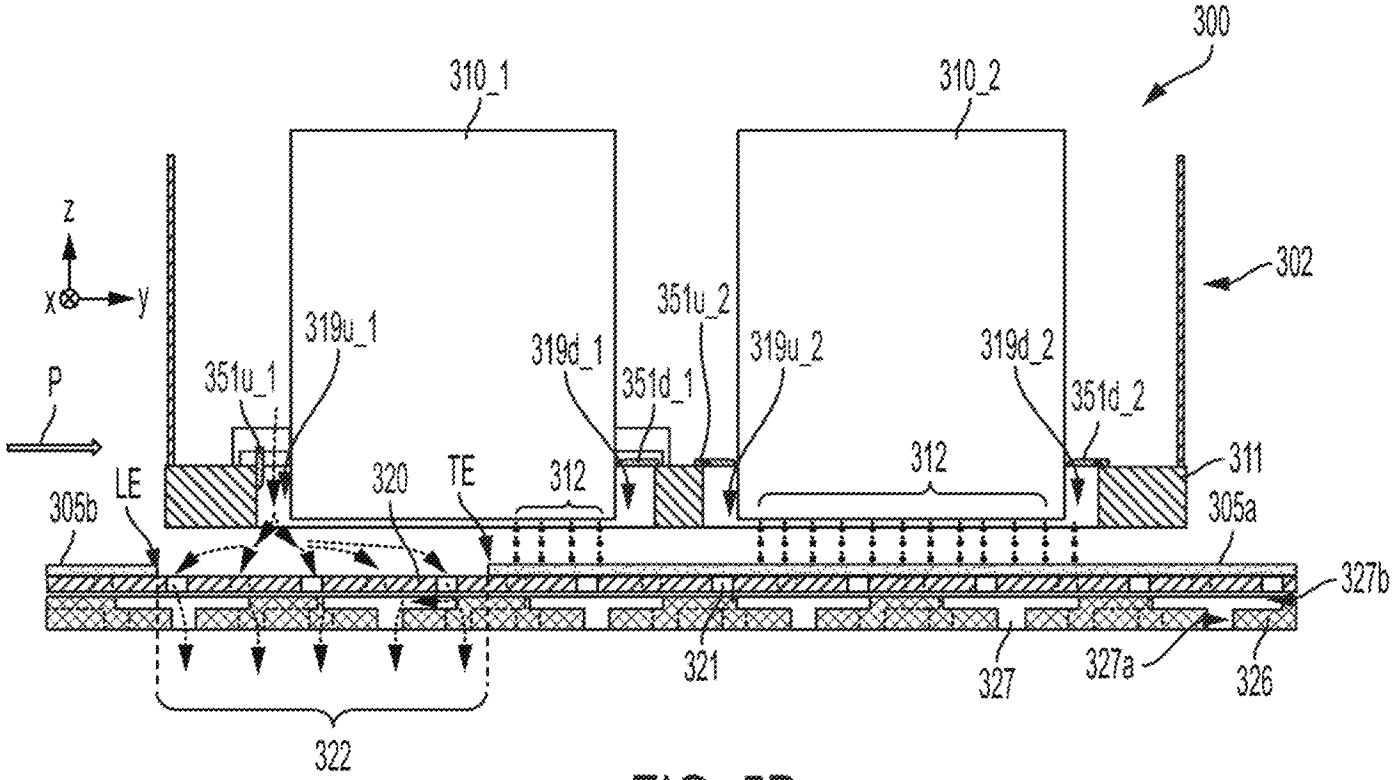

As the trail edge TE of the print media 305*a* continues to move downstream under the printhead 310_1, as shown in FIG. 5B, there is a risk of the inter-media zone 322 inducing crossflows that flow upstream through the deposition region 312 of the printhead 310*u*. However, because the first upstream valve 351*u*_1 is in the open state, air is allowed to flow down through the upstream gap 319*u*_1 towards the inter-media zone 322, as indicated by the dashed lines in FIG. 5B. This airflow counteracts some of the suction from the inter-media zone 322 and raises the pressure in the region above the inter-media zone 322. This reduces the strength with which air is pulled from downstream of the printhead 310_1, and thus the strength of the upstream crossflows is reduced. Moreover, because the valve 351*d*_1 is in the closed state, the crossflows that would otherwise have originated through the downstream gap 319*d*_1, as discussed above in relation to FIG. 1A, are prevented, thus further reducing the upstream crossflows.

Figure 5C:
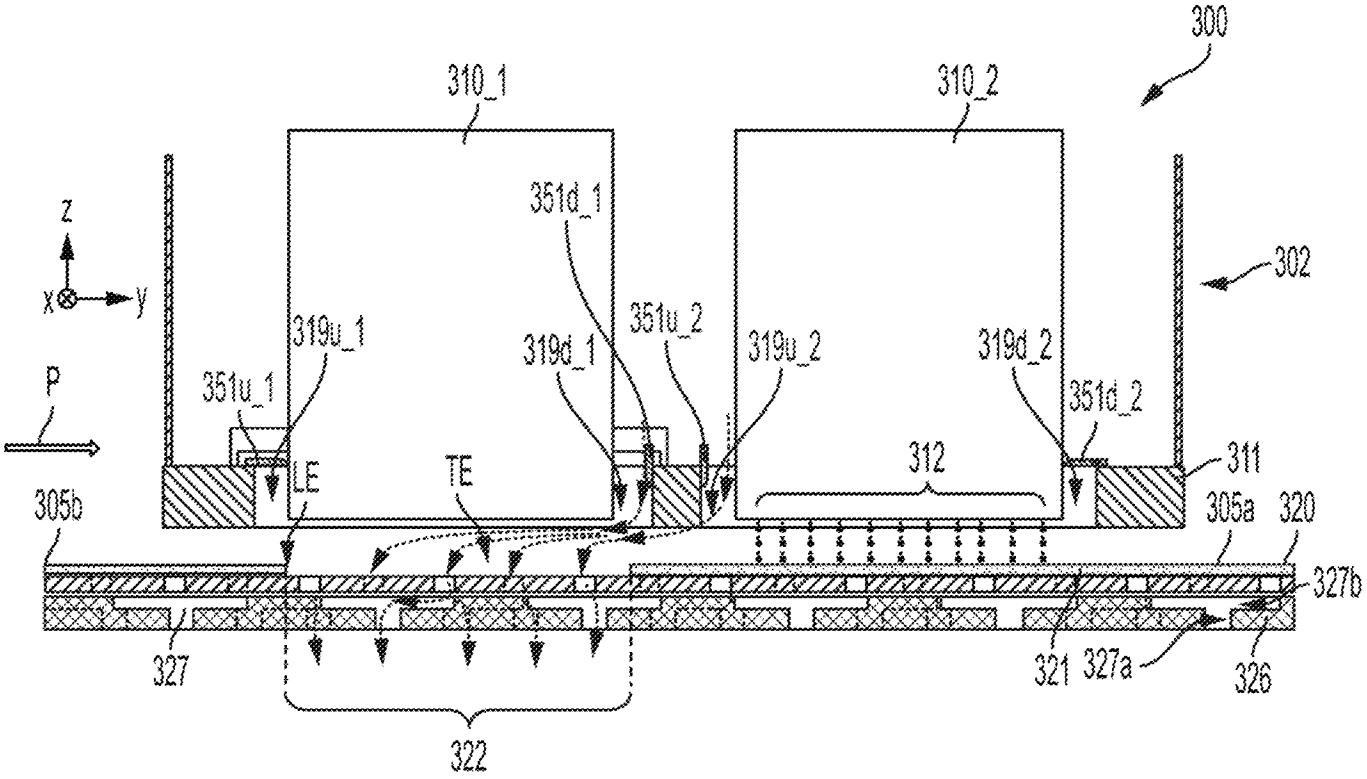

FIG. 5C illustrates the inter-media zone 322 at a position in which the downstream edge of the inter-media zone 322 (i.e., the trail edge TE of the print medium 305*a*) is at a downstream trigger location associated with the valve 351*u*_1. Specifically, in this example, the downstream trigger location associated with the valve 351*u*_1 is the downstream face of the printhead 310. Thus, at (or shortly before) the timing when the trail edge TE of the print medium 305*a* reaches this location, the valve 351*u*_1 is closed. In this configuration, the valve 351*u*_1 blocks airflow through the upstream gaps 319*u*_1. In other embodiments, rather than closing the valve 351*u*_1 based on the trail edge TE reaching the downstream trigger location associated with the valve 351*u*_1, the valve 351*u*_1 may be closed based on the lead edge LE reaching the upstream trigger location associated with the valve.

In the illustrated example, the upstream trigger locations associated with the valves 351*d*_1 and 351*u*2 happen to be the same as the downstream trigger location of the valve 351*u*_1, i.e., the downstream face of the printhead 310_1. Thus, in this example, at the same time that the valve 351*u*_1 is closed, the valves 351*d*_1 and 351*d*_2 are opened. In other embodiments, the upstream trigger locations associated with the valves 351*d*_1 and 351*u*_2 are not necessarily the same as the downstream trigger location of the valve 351*u* _1.

Figure 5D:
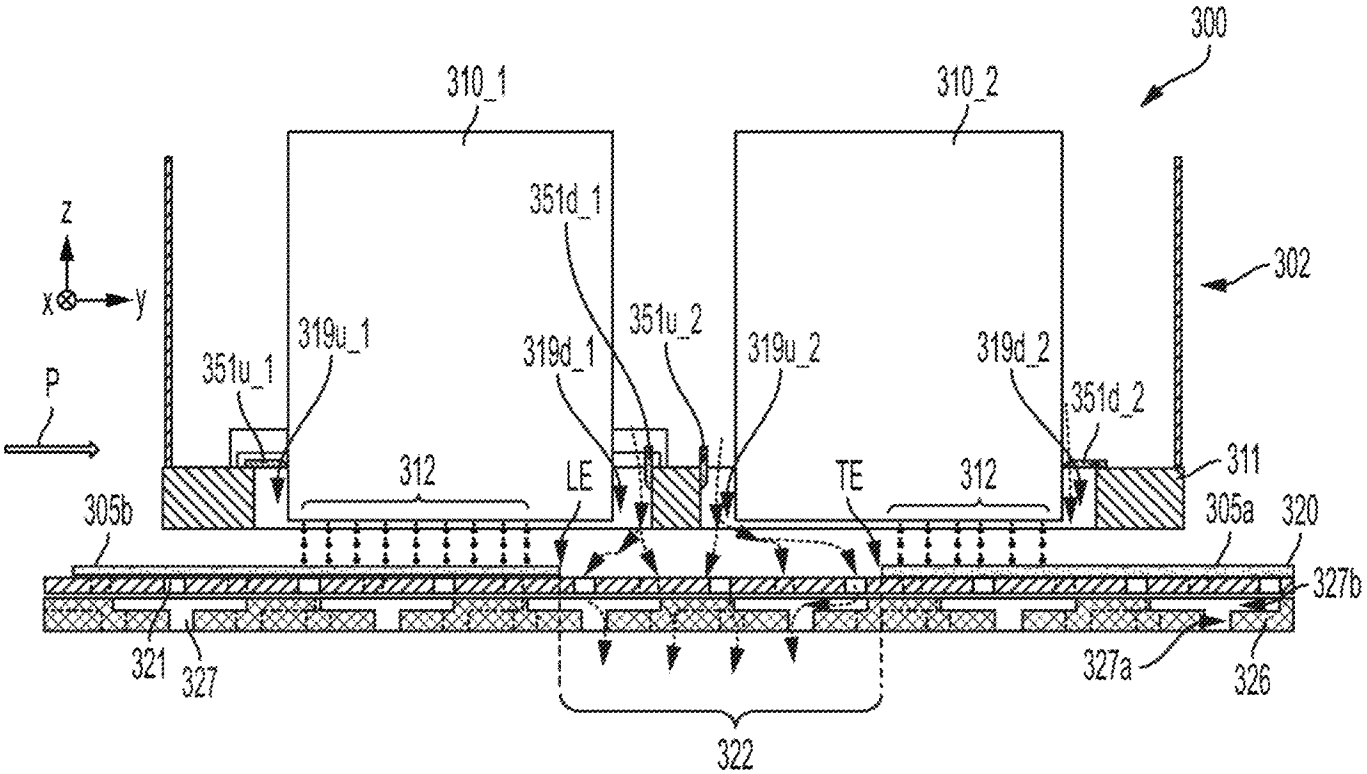

After the timing illustrated in FIG. 5C, the lead edge LE of the print medium 305*b* will start to move under the printhead 310_1 and printing will begin near that lead edge LE, as shown in FIG. 5D. Moreover, the trail edge TE of the print medium 305*a* will start to move under the printhead 310_2. Thus, after the state illustrated in FIG. 5C, there is a risk that the inter-media zone 322 induces both downstream crossflows through the ink deposition region 312 of the printhead 310_1 and upstream crossflows through the ink deposition region 312 of the printhead 310_2. However, as shown in FIG. 5D, because the valves 351*d*_1 and 351*u*_2 are in the open state, beneficial airflows can flow through the gaps 319*d*_1 and 319*u*_2 to counteract the negative pressure from the inter-media zone 322 and reduce the strength of the crossflows. Moreover, because both valves 351*u*_1 and 351*d*_2 are in the closed state, the crossflows that might otherwise have originated through the gaps 319*u*_1 and 319*d*_2 are prevented, thus further reducing crossflows.

Figure 5E:
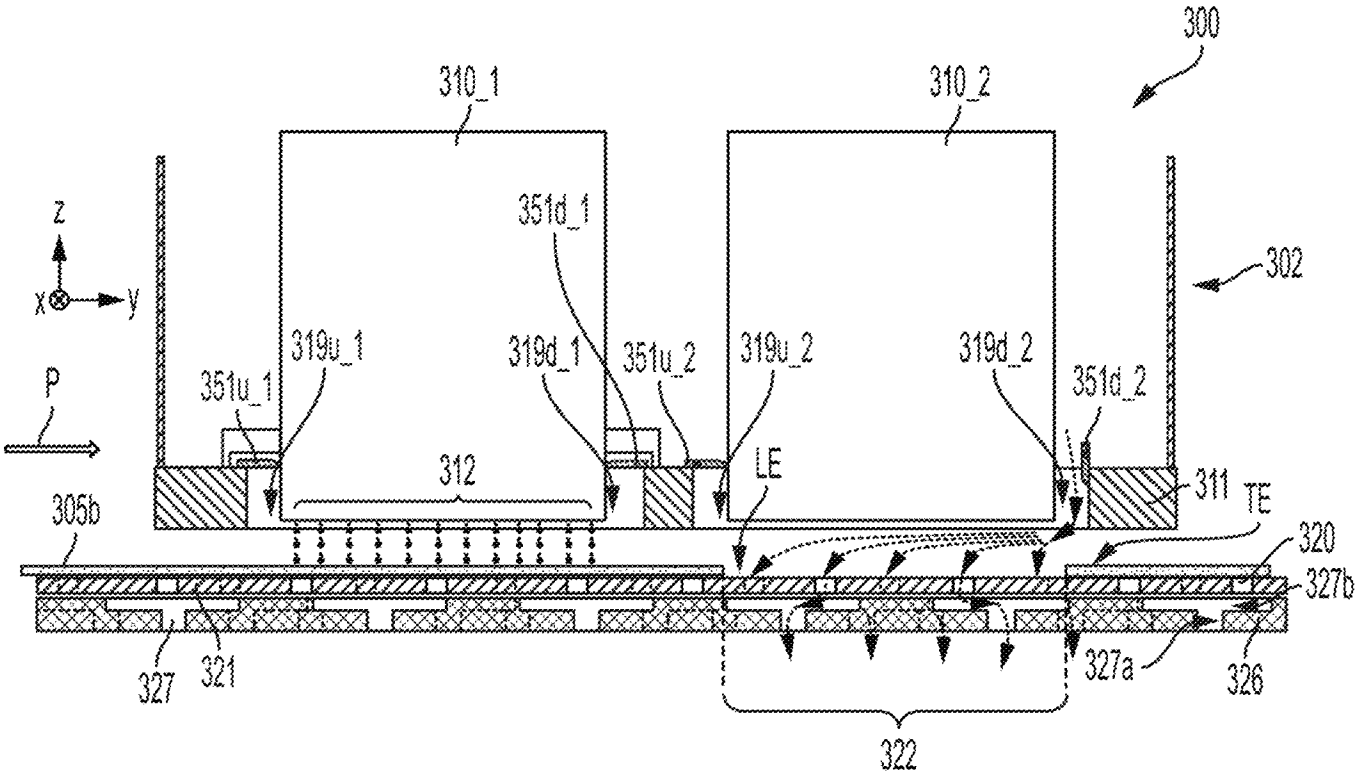

FIG. 5E illustrates the inter-media zone 322 at a position in which the downstream edge of the inter-media zone 322 (i.e., the trail edge TE of the print medium 305*a*) is at a downstream trigger location associated with the valve 351*d*_1, a downstream trigger location associated with the valve 351*u*_2, and an upstream trigger location associated with the valve 351*d*_2. Specifically, in this example, the aforementioned trigger locations are all the same, namely the downstream face of the printhead 310_2. Thus, at (or shortly before) the timing when the trail edge TE of the print medium 305*a* reaches this location, the valves 351*d*_1 and 351*u*_2 are closed and the valve 351*d*_2 is opened. In other embodiments, rather than closing the valves 351*d*_1 and 351*u*_2 based on the trail edge TE reaching the downstream trigger locations associated with the respective valves 351, the valve 351*d*_1 and 351*u*_2 may be closed based on the lead edge LE reaching upstream trigger locations associated with the respective valves 351.

In the illustrated example, the downstream trigger locations associated with the valves 351*d*_1 and 351*u*_2 happen to be the same as the upstream trigger location of the valve 351*d*_2, i.e., the downstream face of the printhead 310_2. However, in other embodiments, these trigger locations are not necessarily the same as one another, and thus the valves 351 are not necessarily actuated at the same time.

Figure 5F:
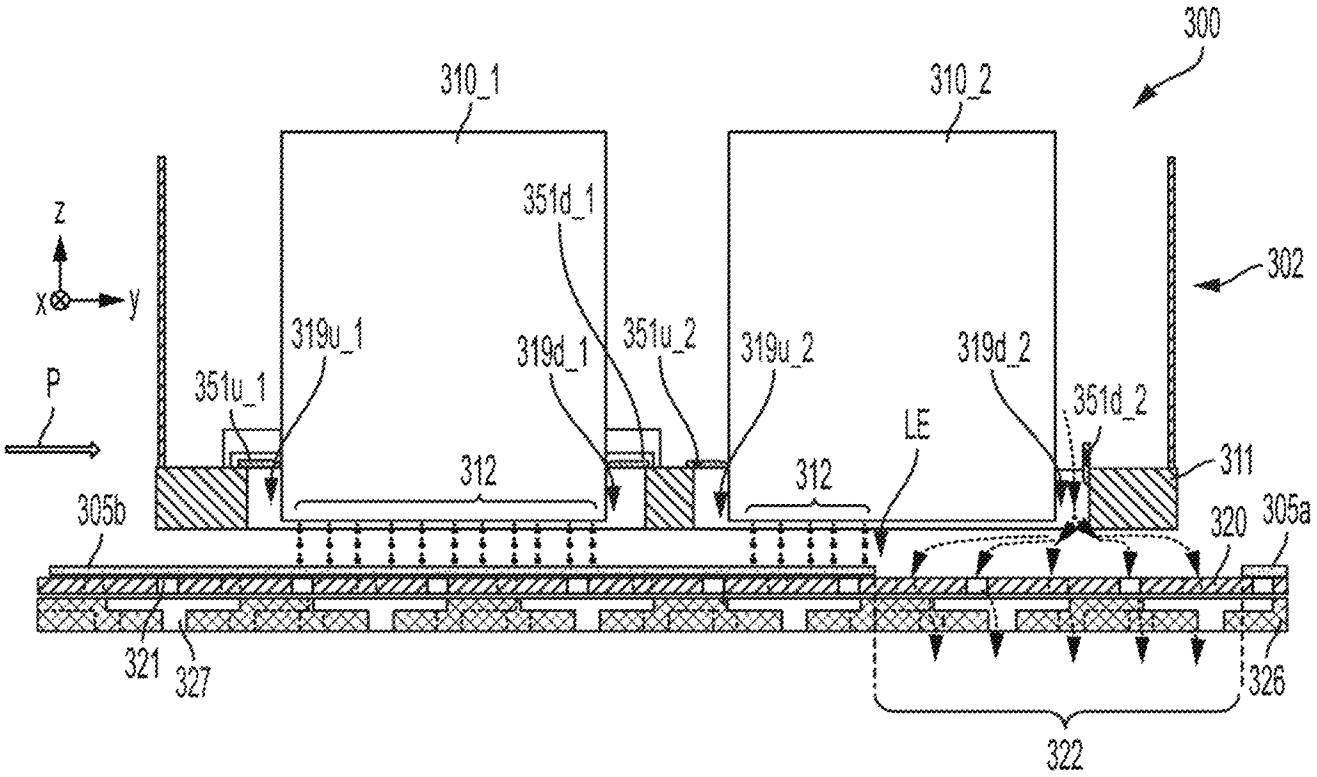

As the lead edge LE of the print medium 305*b* continues to move under the printhead 310_2, there is a risk of the inter-media zone pulling crossflows downstream through the ink deposition region 312 of the printhead 310_2. However, as shown in FIG. 5F, because the downstream valve 351*d*_2 is in the open state, beneficial airflows can flow through the gap 319*d*_2 to counteract the negative pressure from the inter-media zone 322 and reduce the strength of the crossflows. Moreover, because both valves 351*d*_1 and 351*u*_2 are in the closed state, the crossflows that might otherwise have originated through the gaps 319*d*_1 and 319*u*_2 are prevented, thus further reducing crossflows.

After the inter-media zone 322 has fully passed the printhead module 302, the states of the valves 351 becomes less important from the perspective of reducing crossflows, as the inter-media zone 322 will likely be too distant to induce any significant crossflows. Thus, the valves 351 may be placed in any desired state once the inter-media zone 322 has moved past their corresponding printhead module 302. For example, the valve 351*u*_1 may be opened and the other valves 351 may be closed so that they are ready for appearance of the next inter-media zone 322.

Although the airflow control system 350, including the valves 351 and actuators 359, were described above in the context of a specific embodiment of a printing system 300, it should be understood that other embodiments of a printing system may utilize the same airflow control system 350 or a similar airflow control system. For example, embodiments of a printing system having differently configured ink deposition assemblies or differently configured media transport devices could utilize valves similar to the valves 351. For example, in an embodiment that has a different number of printhead modules or printheads than the printing system 300, the same airflow control system 350 may be used except that the number of valves 351 may be modified to account for the number of printhead modules and printheads. In an embodiment that has a different arrangement of the printheads than in the printing system 300, valves similar to the valves 351 may be used except that the arrangement of the valves 351 may be changed to match that of the printheads. In embodiments that have different media transport devices, the same airflow control system 350 may be used, generally without needing any modification. Thus, the airflow control system 350 or similar versions thereof may be utilized in a variety of printing systems besides the specific printing system 300 described above.

FIGS. 6A-6D illustrate a printing system 600, which may be used as the printing system 100 described above with reference to FIG. 2. FIGS. 6A-6D comprise cross-sections of the printing system 600 with the section taken along a process direction, with each of FIGS. 6A-6D showing a sequence of states as the print media 605*a* and 605*b* are transported past one of the printhead modules 602.

The printing system 600 compromises an ink deposition assembly, a media transport device 603, and an airflow control system 650, which can be used as the ink deposition assembly 101, media transport device 103, and airflow control system 150, respectively, of FIG. 2. The printing system 600 may also comprise additional components, such as a control system (e.g., the control system 130).

The ink deposition assembly comprises one or more printhead modules 602 that each have one or more printheads 610 that eject print fluid (e.g., ink) through printhead openings 619 of a carrier plate 611. The printhead modules 602, printheads 610, and carrier plate 611 can be used as the printhead modules 102, printheads 110, and carrier plate 111, respectively. Although only one printhead module 602 is illustrated to simplify the discussion, in practice multiple printhead modules 602 may be provided. In particular, the ink deposition assembly may be configured similarly to the ink deposition assembly 301 described above, and thus duplicative description of its components is omitted.

The media transport device 603 comprises a vacuum platen 626 with holes 627, and a movable support surface 620 with holes 621. The media transport device 603 may be configured similarly to the media transport device 303 described above, and thus duplicative description of its components is omitted.

In the embodiment of FIGS. 6A-6D, the airflow control system 650 comprises threshold valves 651, which can be used as the valves 151 described above. Unlike the valves 351 which are actively actuated by an actuator 359, the threshold valves 651 are passively actuated by pressure differentials. When the difference between the pressure on one side of the valve 651 (e.g., a top side) and the pressure on the other side of the valve 651 (e.g., a bottom side) exceeds a threshold, the valve 651 automatically moves to an open state. Conversely, when the pressure differential is lower than the threshold, the valve 651 moves to a closed state. Thus, in practice, the threshold valves 651 tend to block relatively weak airflows (airflows associated with pressure differentials lower than the threshold) while allowing relatively strong airflows (airflows associated with pressure differentials above the threshold) to pass.

The threshold valves 651 may be formed from materials with sufficient rigidity to allow the valves 651 to support their own weight and remain in a blocking position when the pressure differential is below a threshold, and yet sufficient flexibility that the valves 651 can move, deform, and/or bend to an open position when the pressure differential rises above the threshold. For example, the valves may be formed from plastics, rubber, silicon, various polymers, thin metals, etc. In addition, commercially available threshold valves exist which could be used as the threshold valves 651.

The threshold used for the threshold valves 651 may be any desired threshold. In some embodiments, the threshold may be sufficiently high that each threshold valve 651 remains closed when the inter-media zone 622 is under the printhead module but relatively distant from the valve 651, and sufficiently low that each threshold valve 651 opens when the inter-media zone 622 is near (e.g., under) the valve 651. More specifically, in some embodiments, the threshold may be sufficiently high that each threshold valve 651 remains closed when the inter-media zone 622 is under the printhead module 102 but not directly under the valve 651 itself, and sufficiently low that each threshold valve 651 opens when the inter-media zone 622 is directly under the valve 651 itself. The optimal value for the threshold may vary from system to system, depending on the physical characteristics of the system and the desired operation of the printing system overall. Generally, the stronger the suction generated by the inter-media zone the higher the threshold that may be implemented to trigger the valve, and the suction generated by the inter-media zone may vary from system to system based on factors such as the strength of suction generated by the media transport device, the size of the inter-media zone, the number and size of holes in the movable support surface and vacuum platen, the distance from the movable support surface to the carrier plate, and so on. A desired threshold may be determined, for example, by testing different threshold valves 651 in the system and identifying one that obtains desired results, such as acceptable image blur.

Similar to the valves 351, each valve 651 is transitionable between open and closed states based on the position of the inter-media zone 622. However, rather than a controller tracking the position of the inter-media zone 622 and sending signals to actuate the valves at the appropriate timings, the threshold valves 651 are actuated passively and automatically by the suction of the inter-media zone 622 as it passes the valves 651, as explained in greater detail below in relation to FIGS. 6A-6D.

Figure 6A:
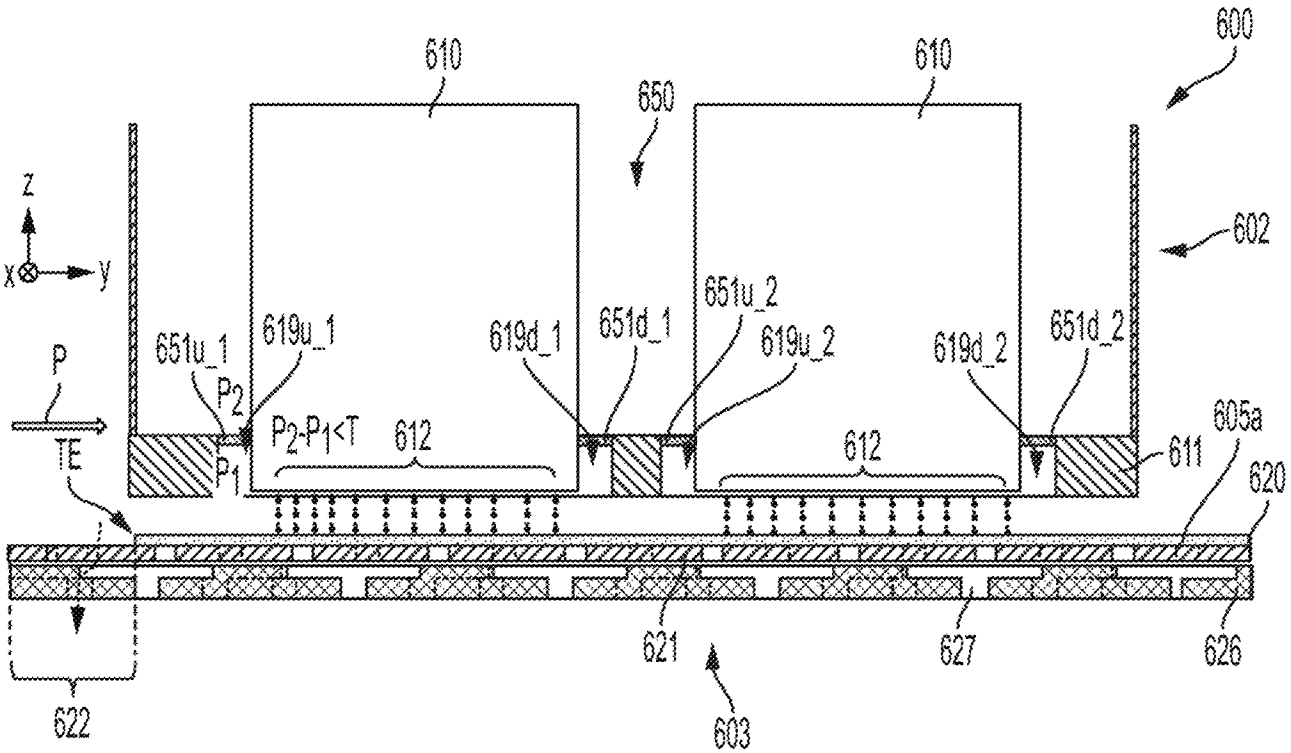
FIGS. 6A-6D are cross-sectional views of an inkjet printing system, with the cross-section taken along the process direction.

FIG. 6A illustrates at state in which the inter-media zone 622 is not yet under the printhead module 602. Thus, the vacuum suction experienced near the printheads 610 is still relatively weak, and the pressure differential across each of the threshold valves 651 is lower than the threshold T. For example, the difference between the pressure $P_2$ above the upstream valve 651*u*_1 and the pressure $P_1$ under the upstream valve 651*u*_1 is greater than the threshold T, and therefore the valve 651*u*_1 remains in the closed state. The same is true for the other valves 651.

Figure 6B:
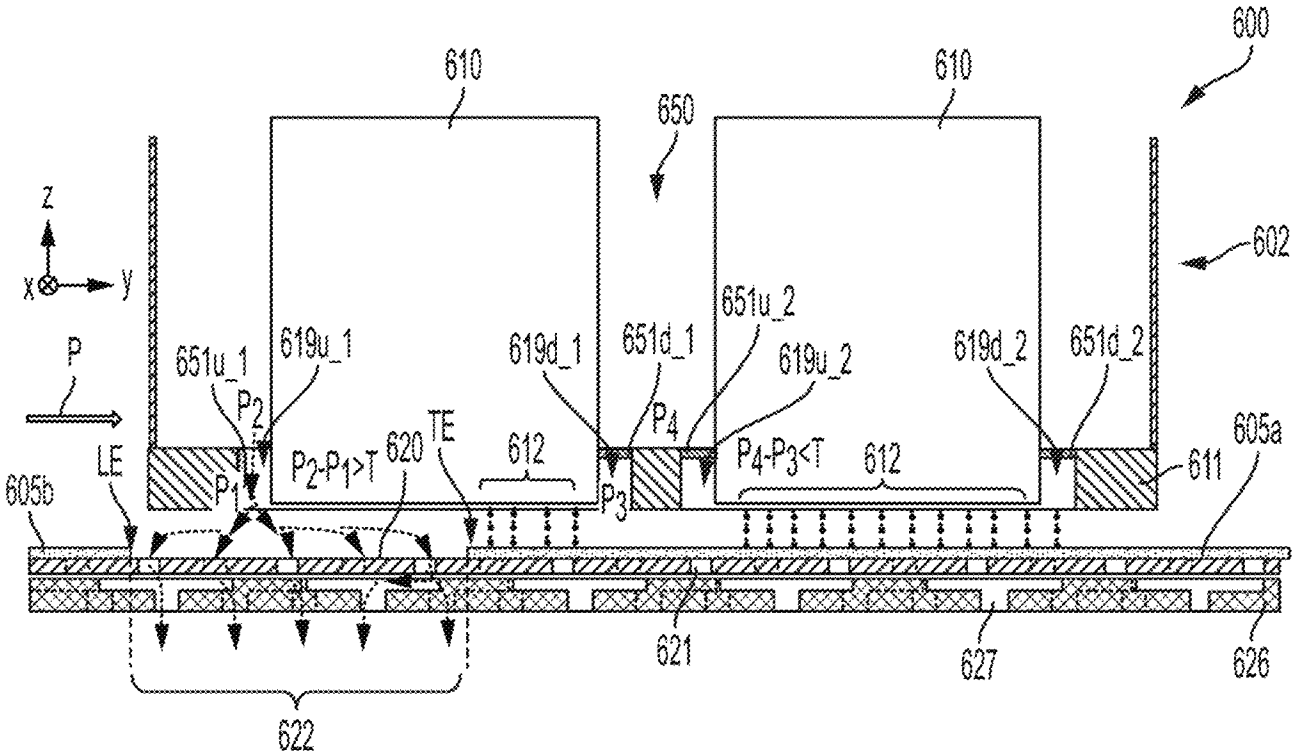

As the inter-media zone 622 advances under the printhead module 602, the pressure drops in the regions under the carrier plate 611 that are near (e.g., directly above) the inter-media zone 622. Thus, as shown in FIG. 6B, when the inter-media zone 622 is below the first upstream valve 651*u*_1, the pressure $P_1$ in the upstream gap 619*u*_1 is lowered sufficiently that the pressure differential $P_2$-$P_1$ becomes greater than the threshold T. Therefore, the valve 651*u*_1 is in the open state, and air is allowed to flow through the gap 619*u*_1 towards the inter-media zone 622. This airflow helps to counteract the suction from the inter-media zone 622, and thus reduces the strength with which air is pulled from downstream of the printhead 610, thus reducing the strength of crossflows. In contrast, because the inter-media zone 622 is not sufficiently close to the valve 651*d*_1 the pressure differential $P_4$-$P_3$ remains lower than the threshold T and the valve 651*d*_1 remains closed. The same is true for the valve 651*u*_2. Thus, the valves 651*d*_1 and 651*d*_2 block airflows through the downstream gap 619*d*_1 and upstream gap 619*u*_2, respectively, further reducing the occurrence and strength of crossflows.

As the inter-media zone 622 advances further under the printhead module 602, it will eventually move under each of the remaining valves 651*d*_1, 651*u*_2, and 651*d*_2 in turn, and when the inter-media zone 622 gets sufficiently close to the respective valves 651 the pressure differentials across the valves 651 will become sufficiently large that each of the valves 651 will be automatically opened, in turn, by the suction from the inter-media zone 622. Moreover, as the inter-media zone 622 advances, it will eventually move away from each of the valves 651 in turn, and thus when the when the inter-media zone 622 is sufficiently distant from the respective valves 651 the pressure differentials across the valves 651 will become sufficiently small that each of the valves 651 will automatically close in turn.

Figure 6C:
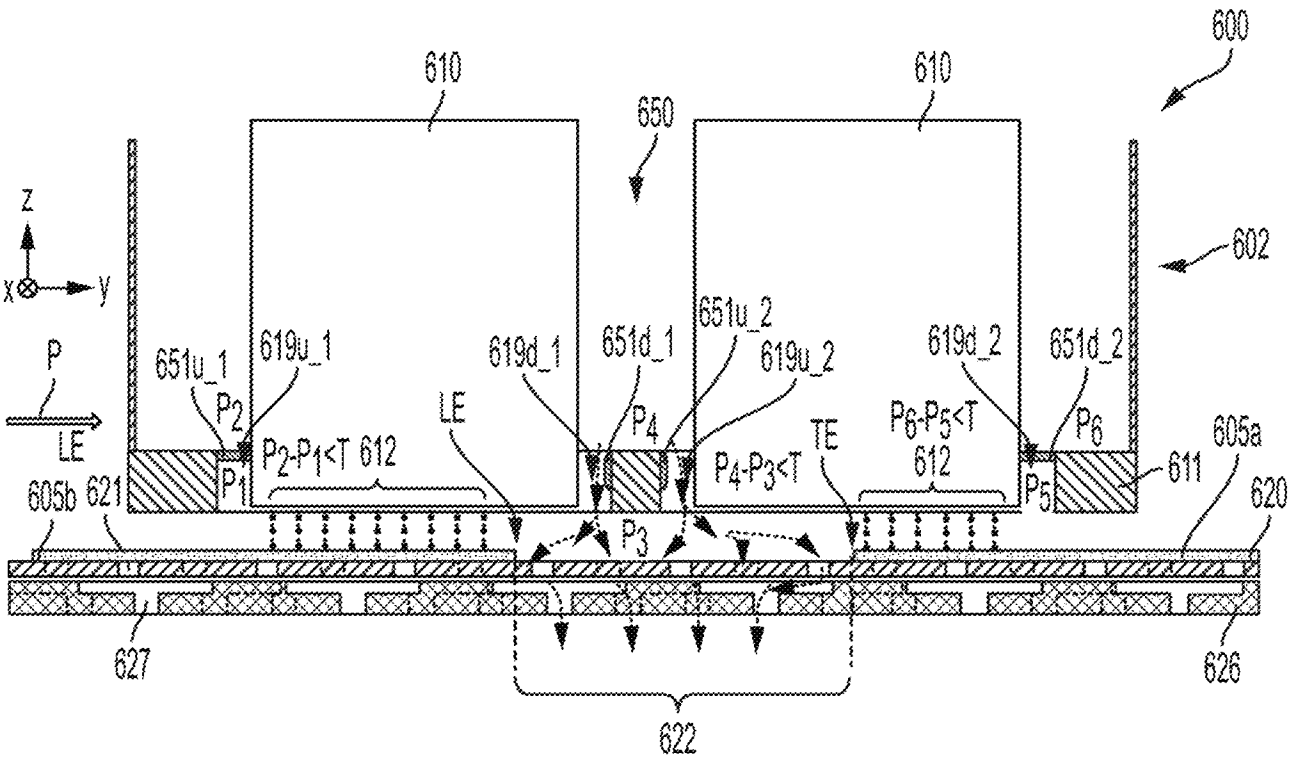

For example, FIG. 6C illustrates a state in which the inter-media zone 622 is under the valves 651*d*_1 and 651*u*_2, and thus the pressure differential $P_4$-$P_3$ across these valves 651 is greater than the threshold T and the valves 651*d*_1 and 651*u*_2 are in the open state. Accordingly, beneficial airflows are allowed to flow through the gaps 619*d*_1 and 610*u*_2, counteracting the suction from the inter-media zone 622 and reducing the strength of crossflows. At this same point in time, the inter-media zone 622 is not under the valves 651*u*_1 and 651*d*_2 and therefore the pressure differentials $P_2$-$P_1$ and $P_6$-$P_5$ across these valves 651 are both lower than the threshold T and the valves 651*u*_1 and 651*d*_2 are the closed state. Thus, crossflows through the gaps 619*u*_1 and 619*d*_2 are prevented.

Figure 6D:
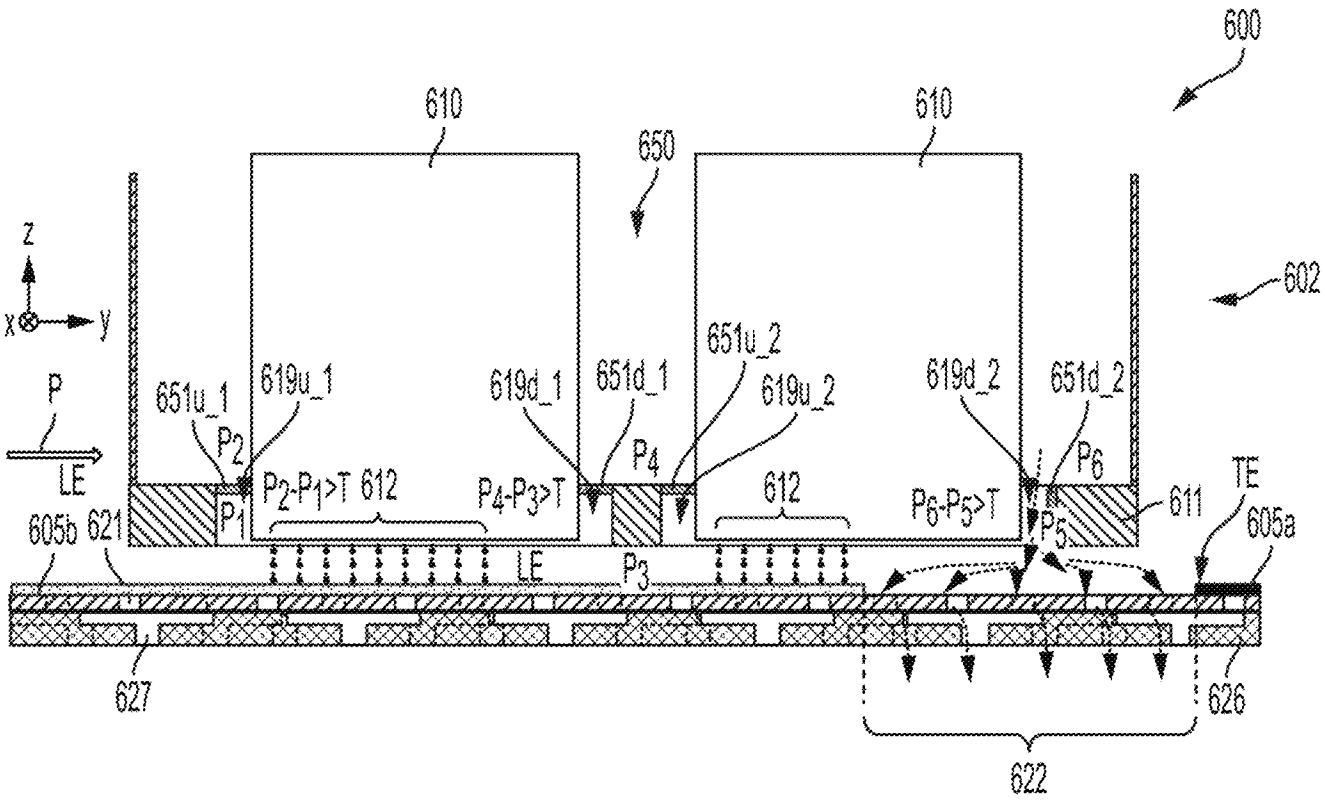

FIG. 6D illustrates a state in which the inter-media zone 622 is under the valve 651*d* _2, and thus the pressure differential $P_6$-$P_5$ across the valve 651*d*_2 is greater than the threshold T and the 651*d*_2 is in the open state. Accordingly, beneficial airflows are allowed to flow through the gap 619*d*_2, counteracting the suction from the inter-media zone 622 and reducing the strength of crossflows. At this same point in time, the inter-media zone 622 is not under any of the other valves 651 and therefore the pressure differentials across these valves 651 are all lower than the threshold T and these valves 651 are the closed state. Thus, crossflows through the gaps 619*d*_1 and 619*u*_2 are prevented.

Figure 7:
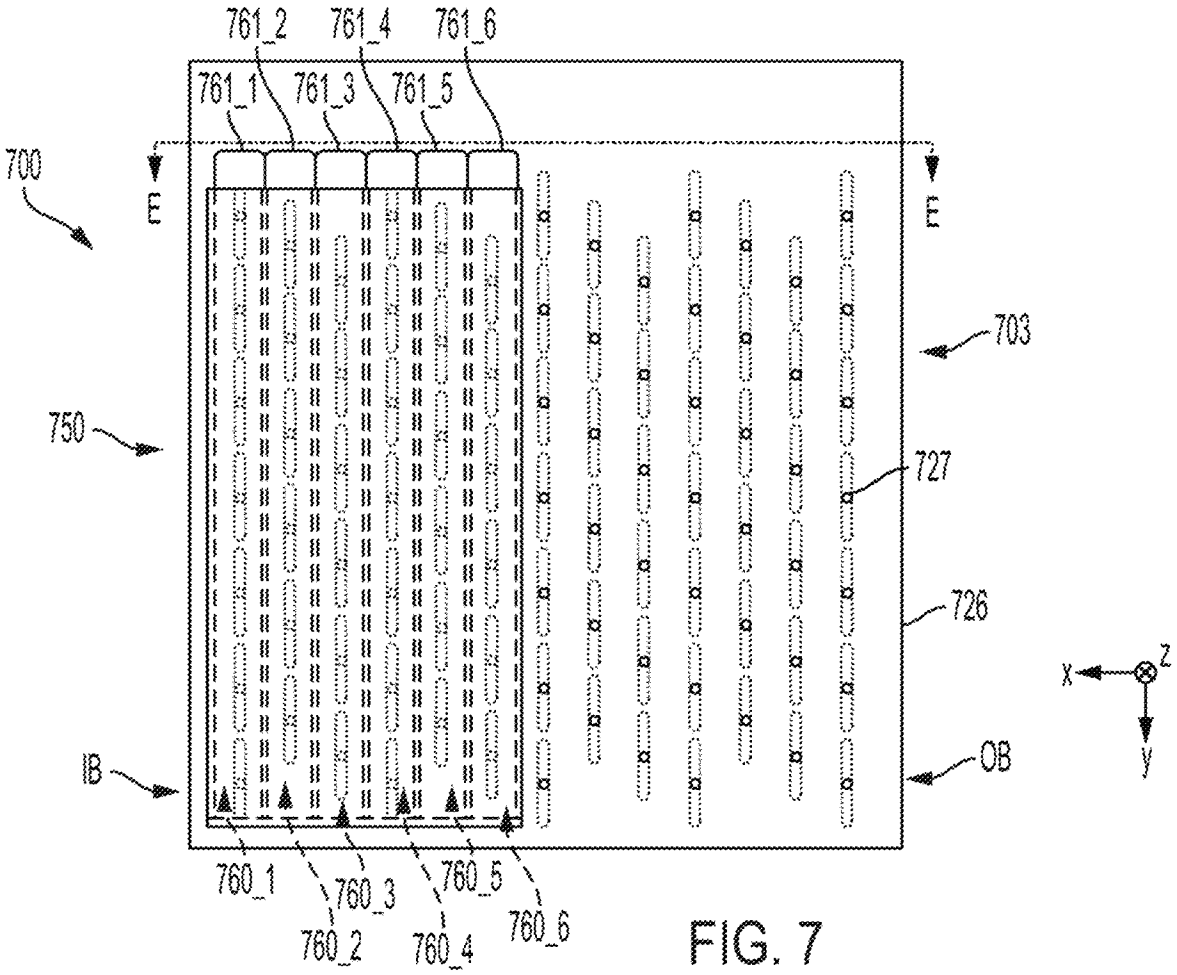
FIG. 7 is a plan view from below a vacuum platen of an embodiment of an inkjet printing system.
Figure 8A:
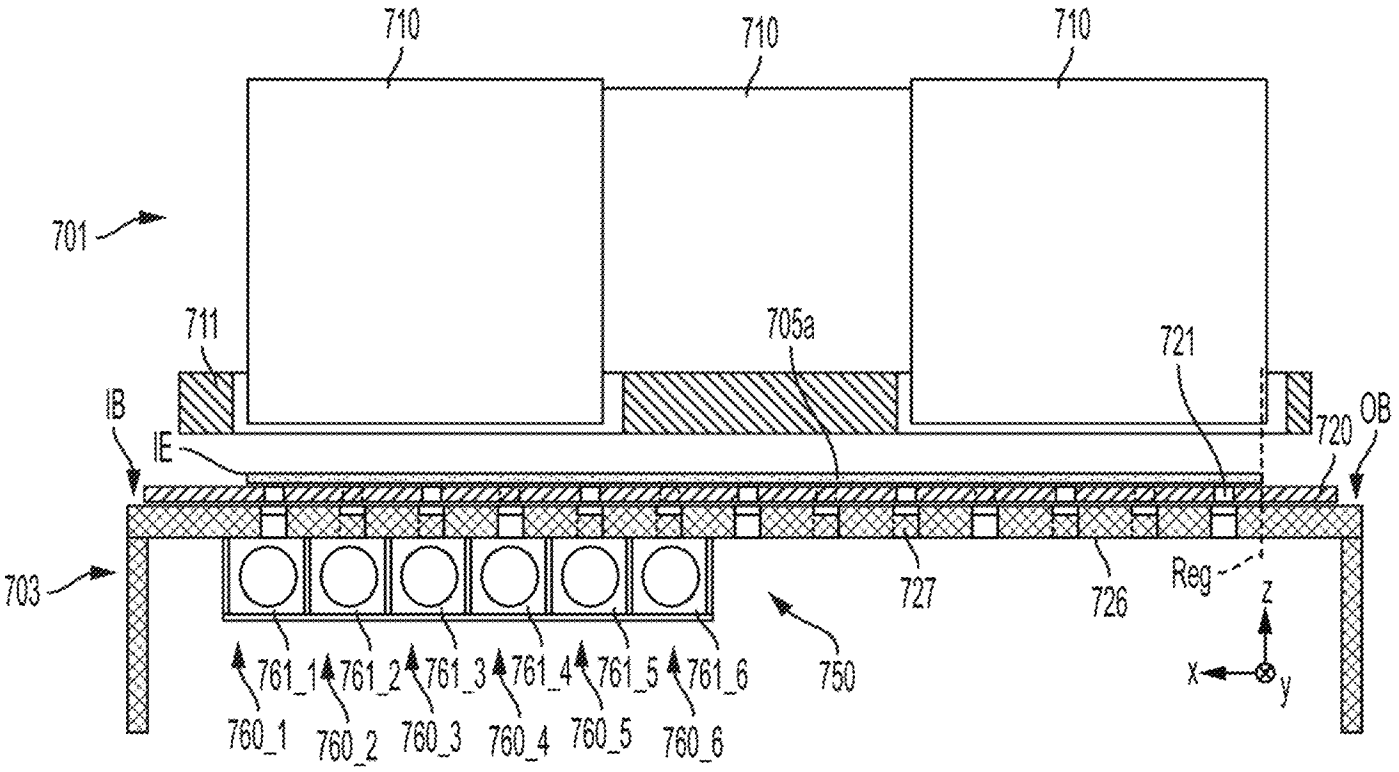
FIGS. 8A-8C are cross-sectional views of the inkjet printing system of FIG. 7, with the cross-section taken along E in FIG. 7.
Figure 8B:
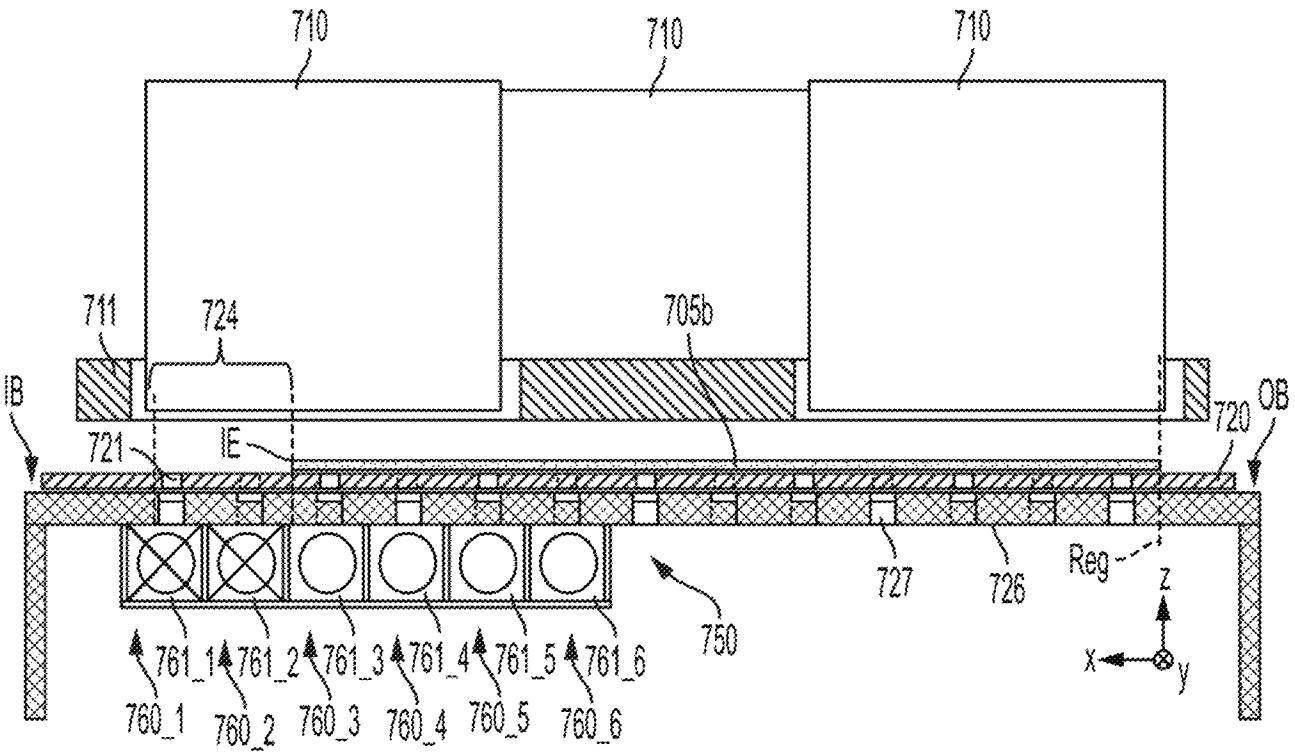
Figure 8C:
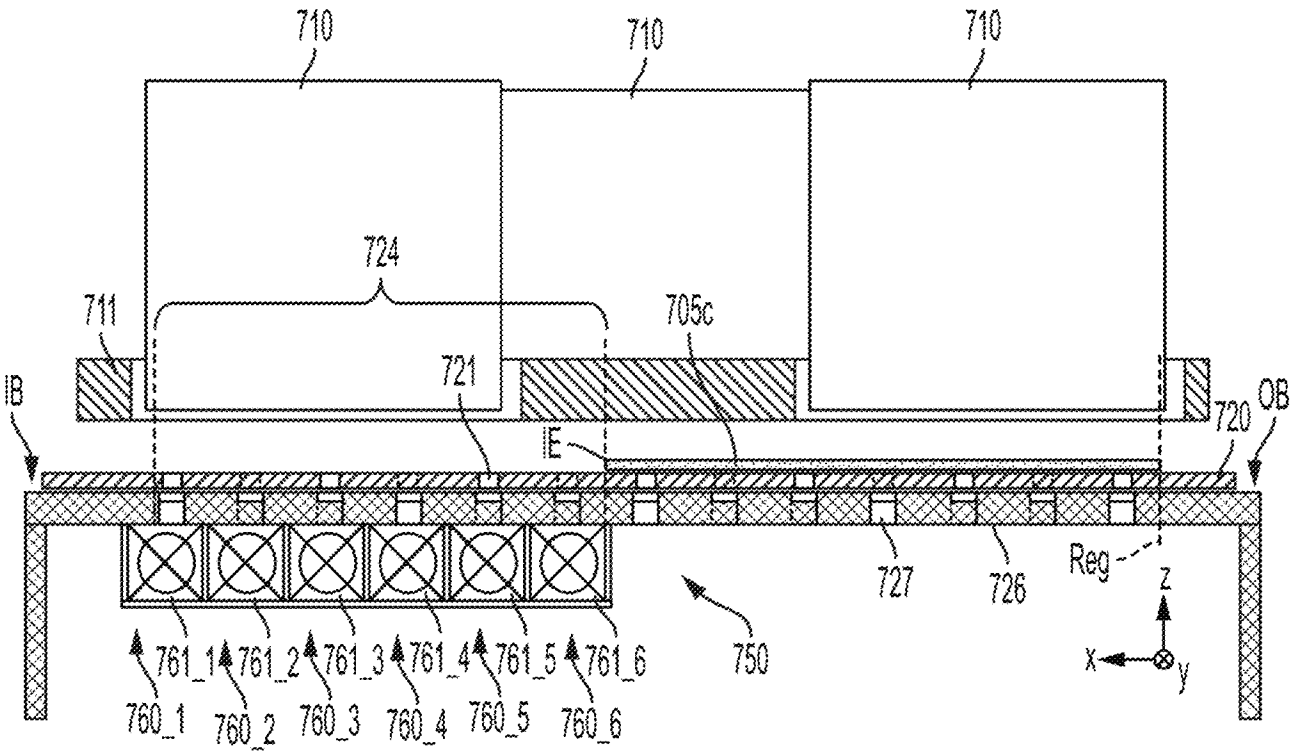

FIGS. 7-8C illustrate a printing system 700, which may be used as the printing system 100 described above with reference to FIG. 2. FIG. 7 comprises a plan view from below a vacuum platen 726. FIGS. 8A-8C comprise cross-sections taken along E in FIG. 7, with each of FIGS. 8A-8C showing different sizes of print media 705 being printed.

The printing system 700 comprises an ink deposition assembly 701, a media transport device 703, and an airflow control system 750, which can be used as the ink deposition assembly 101, media transport device 103, and airflow control system 150, respectively. The printing system 700 may also comprise additional components, such as a control system (e.g., the control system 130).

The ink deposition assembly 701 comprises one or more printhead modules that each have one or more printheads 710 that eject print fluid (e.g., ink) through printhead openings of a carrier plate 711. The printhead modules, printheads 710, and carrier plate 711 can be used as the printhead modules 102, printheads 110, and carrier plate 111, respectively. The ink deposition assembly may be configured similarly to the ink deposition assembly 301 described above, and thus duplicative description of its components is omitted.

The media transport device 703 comprises a vacuum platen 726 with holes 727, and a movable support surface 720 with holes 721. The media transport device 703 may be configured similarly to the media transport device 303 described above, and thus duplicative description of its components is omitted.

The airflow control system 750 comprises channels 760 and valves 761. The channels 760 are independently addressable, which means that they can be independently turned on or turned off. In this context, a channel 760 being "on" refers to airflow being allowed through the holes 727 associated with the channel 760, while the channel being "off" refers to airflow not being allowed through the holes 727 associated with the channel 760. The valves 761 are coupled with the channels 760 to control whether the respective channels 760 are on or off (i.e., to control airflow through the channels 760 and their associated holes 727). When a valve 761 is open, airflow is allowed through the corresponding channel 760, and thus vacuum suction through the corresponding holes 727 is enabled (i.e., the channel 760 is on). When a valve 761 is closed, airflow through the channel 760 is stopped, and thus vacuum suction through the corresponding holes 727 is stopped (i.e., the channel 760 is off).

As shown in FIGS. 7-8C, the channels 760 comprise structures that define a passageway through which the vacuum suction of the vacuum plenum 725 is communicated to a corresponding group of holes 727. In particular, the channels 760 each correspond to at least one column of holes 727 in the platen 726, with the channels 760 and the columns of holes 727 both extending in the process direction (y-axis direction). The channels 760 comprises one or more openings through which the vacuum suction inside the vacuum plenum is communicated to the interior of the channels 760, and the valves 761 are positioned at the one openings to selectively fluidically couple the channels 760 to the vacuum plenum. In FIGS. 7-8C, the channels 760 are illustrated as elongated box-like structures (rectangular prisms) each with a valve 761 at one end through which air enters the channels 760, but the configuration of the channels 760 and valves 761 is not so limited. The channels 760 and valves 761 may have any shape and configuration that allows them selectively allow or block airflow between the vacuum plenum and the corresponding group of holes 727. For example, the channels 760 could be recessed into a bottom surface of the platen 726 rather than extending out from the bottom surface of the platen 726. As another example, the valves 761 could be positioned differently, such as on a bottom side of the channels 760 or on an opposite end of the channels 760, for example, to block the outlet end of a channel from the vacuum source. As another example, multiple valves 761 could be provided for each channel 760 to reduce the airflow impedance of the channel 760. Moreover, the group of holes 727 whose airflow is controlled by a channel 760 can, but does not necessarily have to, include all of the holes 727 in the corresponding column of holes 727. In some embodiments, a channel 760 controls airflow through at least those holes 727 of their corresponding column(s) that are in or near the deposition region of the ink deposition assembly. One of ordinary skill in the art could envision a variety of arrangements of channels, holes and valves without departing from the scope and principles of operation disclosed herein.

In FIGS. 7-8C, six channels 760 are illustrated. However, in practice any number of channels 760 may be provided. In some embodiments, the channels 760 are provided for each column of holes 727 in the platen 726, while in other embodiments channels 760 are provided for less-than-all of the columns. In some embodiments in which channels 760 are provided for less-than-all of the columns of holes 727, the channels 760 are positioned to cover the N columns of holes 727 that are closest to the side of the platen 727 at which the uncovered region 724 appears, where N is the number of channels 760—for example, in FIGS. 7-8C the uncovered regions 724 appear on the inboard side (IB) of the platen 726 and therefore the six channels 760_1 through 760_6 are provided for the six most inboard columns of holes 727. In some embodiments, the channels 760 are provided for each columns of holes 727 that could possibly be located in an uncovered region 724 in view of the sizes of print media that the printing system is configured to use—for example, if the smallest print media that the printing system is configured to use leaves the K most inboard columns of holes 727 uncovered (where K is any integer), then at least K channels 760 may be provided for at least these K columns of holes 727.

In FIGS. 7-8C, the print media are registered to a registration datum (REG) that is located on an outboard side (OB in FIGS. 7-8C) of the platen 726, and therefore the uncovered region 724 appears on the inboard side of the print media when smaller print media are used. Thus, in such a system, the channels 760 are provided for columns of holes 727 on the inboard side of the platen 726. However, in embodiments in which the print media are registered differently, the channels 760 may be relocated so as to align with the locations in which the uncovered region appears.

In some embodiments, actuators are operably coupled to (or are integral parts of) the valves 761 to move them between the open and closed states. In FIGS. 7-8C the actuators are not illustrated to avoid obscuring other parts. The actuators may be used as the actuators 169 described above.

As shown in FIGS. 8A-8C, the valves 761 may be individually controlled to individually turn the channels 760 on or off based on the size of the print media currently being used (e.g., currently being printed on or currently selected for pending printing). For example, as shown in FIG. 8A, a largest print medium 705*a* that the system is designed to use is selected, and the width of this print medium 705*a* in the cross-process direction is sufficient to cover all of the columns of holes 727. Thus, in this example there is no uncovered region 724 and therefore all of the channels 760 are turned on by moving all of the valves 761 to the open state. The open state of a valve 761 is indicated in the Figures by a circle which schematically represents an open passageway of the valve 761. In contrast, when a smaller print medium 705 is used, as shown in FIGS. 6B-6C, some of the columns of holes 727 are not covered and thus an uncovered region 724 is present. In such a state, each channel 760 that is in the uncovered region 724 is turned off by moving the corresponding valve 761 to a closed state. The closed state of the valve 761 is indicated schematically in FIGS. 8A-8C by an X superimposed over the valve 761. Thus, for example, in FIG. 8B a print medium 705*b* is used whose size is such that the two most inboard columns of holes 727 are uncovered, and therefore the two most inboard channels 760_1 and 760_2 are turned off (i.e., the valves 761_1 and 761_2 are moved. As another example, in FIG. 6C a smallest print medium 705*c* that the printing system is designed to use is selected, and therefore all of the channels 760 are off (i.e., all of the valves 761 are in the closed state). The three illustrated states are nonlimiting and used to demonstrate the principles of operation, and one of ordinary skill in the art would understand that if other sizes of print media are used that cover different numbers of columns of holes 727, then different numbers of channels 760 may be turned on or off accordingly such that the channels 760 that are in the uncovered region 724 are off while those channels 760 that are not in the uncovered region 724 are on. Thus, suction through the holes 727 in the uncovered region 724 is prevented regardless of the size of the print media, and therefore crossflows induced by the uncovered region 724 are eliminated. Moreover, all of the holes 727 that are covered by the print media are allowed to continue to receive the vacuum suction, and thus the suction hold down force on the print media is maintained at full force.

Although the airflow control systems 350, 650, and 750 are illustrated and described above in the context of specific embodiments of printing systems, it should be understood that other embodiments of printing systems may utilize the airflow control systems 350, 650, or 750 described above with or without some slight modifications that would be apparent to those of ordinary skill in the art. For example, in printing systems that have an ink deposition assembly configured differently than those described above in relation to the printing systems 300, 600, and 700 (e.g., a different number, size, shape, or arrangement of printheads or printhead modules), the airflow control systems 350 and 650 described above may be used as long as one or more printheads extend through corresponding openings and there are associated gaps on the upstream and downstream sides of the printheads through which the valves 351 or 651 may selectively block airflow. The number of valves 351 or 651 may be adjusted based on the number of printheads. The shapes and sizes of the valves 351 or 651 may be adjusted based on the shapes and sizes of the gaps they are to block airflow through (the shapes and sizes of the gaps being dependent on the shapes and sizes of the printheads and the openings through which the printheads extend). The airflow control system 700 may be used regardless of the configuration of the ink deposition assembly, except that size of the channels 760 may vary depending on the size of the ink deposition region. As another example, in printing systems that have a media transport device configured differently than those described above in relation to the printing systems 300, 600, and 700, the airflow control system 750 may be used as long as there are holes 727 to provide vacuum suction to the print media, regardless of the shape, number, or arrangement of the holes 727 and regardless of the type or configuration of the moving support surface or vacuum plenum. The number and size of channels 760 may be varied based on the arrangement of holes 727 and the size of an ink deposition region. The airflow control systems 350 and 650 described above may be used regardless of the configuration the media transport device, as long as the media transport device utilizes vacuum suction to hole print media. Thus, the airflow control systems 350, 650, and/or 750, with or without modifications, may be utilized in a variety of printing systems including but not limited to the specific printing systems described above. In addition, the airflow control systems 350, 650, and/or 750, can be used alone or in combination.

As described above, a controller (such as controller 131) determines timings for actuating valves (such as valves 151 or 351) based on the locations of the inter-media zone, with the controller causing the valves to be actuated when the upstream or downstream edges of the inter-media zone reach certain trigger locations. In some embodiments, these trigger locations are predetermined and are programed into the controller 131. For example, the trigger locations may be set to one of the example trigger locations described above. As another example, trigger locations may be determined experimentally by iteratively printing test images on print media, determining an amount of blur in the image, adjusting the trigger location for actuating the valves, and then repeating the process until a desired level of image blur is obtained. The timings that produced that desired level of image blur may then be selected and programmed into the controller as the predetermined timings. In contrast, in some embodiments, the trigger locations (and hence the actuation timings which are based thereon) may be dynamically determined or adjusted during operation of the printing system, for example based on real time feedback. As described above, a controller (such as controller 131) may also determine a width of the print media and actuate valves (such as valves 161 or 761) based on width of the print media. The width of the print media may be determined based on imaging the print media, edge detection sensors, or based on present known paper sizes of the print media.

Figure 9:
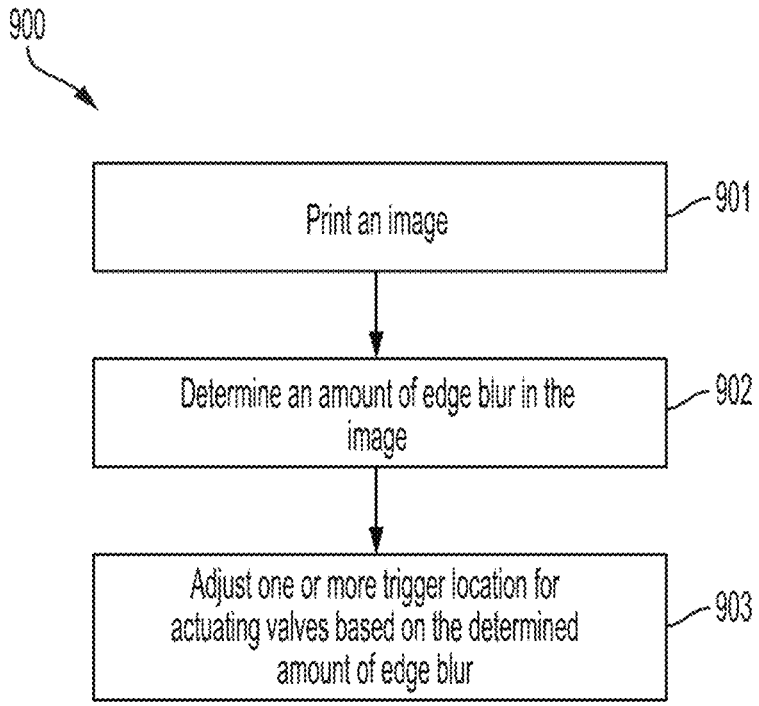
FIG. 9 is process flow chart illustrating an embodiment of a method.

FIG. 9 illustrates an embodiment of a method 900 pertaining to dynamically determining trigger location for actuating the valves (e.g., valves 151 or 351). In one example, the method 900 may be performed automatically by a control system of the printing system, such as the control system 130 of the printing system 100 or a control system of the printing system 300. In some examples the trigger locations (and hence timings) for actuating the valves may be dynamically adjusted during usage of the printing system. In some embodiments, the operations of the method 900 and/or other operations described herein may be embodied in machine-readable instructions (also called computer-readable instructions, processor-executable instructions, code, software, programming, etc.) stored on one or more non-transitory machine readable media (e.g., memory device), with the instructions being such that they, when executed by processing circuitry of the printing system, cause the printing system to perform the operations described herein. The method 900 may also be performed by a user of the printing system, for example by virtue of the user placing the printing system in an operational state in which the printing system carries out the operations of the method 900.

Block 901 comprises printing an image using a printing system comprising an airflow control system according to the various embodiments described herein. In one embodiment, the image may be a test image generated specifically for process of adjusting the valve actuation timings. The test image may comprise a predetermined pattern or shape (e.g., one or more lines). In another embodiment, the image may not be specific to the process of adjusting valve actuation timings—for example, the image may be part of a regular print job unrelated to the adjustment process.

Block 902 comprises determining an amount of edge blur in the printed image. This may involve obtaining an electronic image of the printed image, for example by scanning or photographing the printed image. The electronic image may then be analyzed to determine an amount of blur in the image. For example, brightness values of portions of the electronic image may be sampled and compared to expected brightness values for those portions (the expected brightness values being known from the master image data used to print the image), and an amount of difference between the sampled values and the expected values may represent the amount of image blur in the printed image. As another example, the techniques for measuring blur disclosed in U.S. patent application Ser. No.: 16/818,847, filed on Mar. 13, 2020, which is incorporated herein by reference in its entirety, may be used to determine the amount of edge blur. Any other known image analysis techniques may be used to detect blur in the image.

Block 903 comprises adjusting a trigger location associated with a valve based on the determined amount of edge blur. For example, the amount of edge blur may be used as feedback in a control loop, such as a PID control loop, with the trigger location being the controlled variable. Each valve may have multiple associated trigger locations that need to be set, such as an upstream trigger location and a downstream trigger location as described above. In some embodiments, some valves may have additional trigger locations, such as multiple different downstream trigger locations, and so on. It should be understood that each of the trigger locations corresponds to one or more actuation timings of a valve, since the timings at which the valve is actuated correspond to the timings when portions of the inter-media zone (i.e., the lead edge or trail edge of print media which define the inter-media zone) reach the various trigger locations. A given trigger location may be associated with timings for both opening and closing of the same valve—for example, a given valve may be opened when a downstream edge of the inter-media zone reaches a given trigger location and the valve may be closed when an upstream edge of the inter-media zone reaches the same given trigger location. Different valves may have different trigger locations and different types of action (e.g., opening or closing the valve) may occur based on those trigger locations.

The trigger locations of all of the valves may be determined by repeating the process 900 multiple times, with each iteration varying one or more trigger locations of one or more valves. In some examples, the trigger locations of similarly-situated valves may be set based on the learned trigger location of a given valve, thus avoiding needing to repeat the process 900 for each valve in the group of similarly situated valves. For example, valves that are aligned with one another in the cross-process direction may all have the same trigger locations, and thus the trigger location(s) of just one of these valves needs to be learned and the others may be set accordingly. As another example, in some embodiments, all upstream valves may have the same relative trigger locations—for example, if the downstream trigger location of a given upstream valve is determined to be X mm downstream of the downstream face of the corresponding printhead, then the downstream trigger location of all of the upstream valves may be set to X mm downstream of the downstream face of their corresponding printheads. As another example, the trigger locations of the valves of a first printhead module may be determined by performing the process 900 one or more times, and then the valves of other printhead modules may be set based on the trigger locations of the respective valves of the first printhead module that are in the same relative position.

Although the process 900 is described above in relation to varying trigger locations to learn values for the trigger locations, the same process 900 could equivalently be described as varying the actuation timings to learn values for the actuation timings, since the trigger locations and actuation timings are intrinsically linked.

This description and the accompanying drawings that illustrate inventive aspects and embodiments should not be taken as limiting—the claims define the protected invention. Various mechanical, compositional, structural, electrical, and operational changes may be made without departing from the spirit and scope of this description and the claims. In some instances, well-known circuits, structures, and techniques have not been shown or described in detail in order not to obscure the invention. Like numbers in two or more figures represent the same or similar elements.

As used herein, a valve "blocking" a gap between the rim of the opening and a side of a printhead refers to positioning the valve relative to the gap such that the valve substantially covers or spans the gap and is in sufficiently close proximity to the carrier plate and to the printhead to prevent airflow through the gap. In this context, a valve "preventing" airflow through the gap means that the valve creates a relatively high impedance state through the gap such that airflow through the gap is significantly reduced, as compared to a completely open state (e.g., impedance is increased tenfold and/or airflow is decreased to around 10% of the open state). Thus, blocking the gap and preventing airflow does not necessarily require a hermetic seal or the strict elimination of all airflow.

Further, the terminology used herein to describe aspects of the invention, such as spatial and relational terms, is chosen to aid the reader in understanding embodiments of the invention but is not intended to limit the invention. For example, spatially terms—such as "upstream", "downstream", "beneath", "below", "lower", "above", "upper", "inboard", "outboard", "up", "down", and the like—may be used herein to describe directions or one element's or feature's spatial relationship to another element or feature as illustrated in the figures. These spatial terms are used relative to the poses illustrated in the figures, and are not limited to a particular reference frame in the real world. Thus, for example, the direction "up" in the figures does not necessarily have to correspond to an "up" in a world reference frame (e.g., away from the Earth's surface). Furthermore, if a different reference frame is considered than the one illustrated in the figures, then the spatial terms used herein may need to be interpreted differently in that different reference frame. For example, the direction referred to as "up" in relation to one of the figures may correspond to a direction that is called "down" in relation to a different reference frame that is rotated 180 degrees from the figure's reference frame. As another example, if a device is turned over 180 degrees in a world reference frame as compared to how it was illustrated in the figures, then an item described herein as being "above" or "over" a second item in relation to the Figures would be "below" or "beneath" the second item in relation to the world reference frame. Thus, the same spatial relationship or direction can be described using different spatial terms depending on which reference frame is being considered. Moreover, the poses of items illustrated in the figure are chosen for convenience of illustration and description, but in an implementation in practice the items may be posed differently.

The term "process direction" refers to a direction that is parallel to and pointed in the same direction as an axis along which the print media moves as is transported through the deposition region of the ink deposition assembly. Thus, the process direction is a direction parallel to the y-axis in the Figures and pointing in a positive y-axis direction.

The term "cross-process direction" refers to a direction perpendicular to the process direction and parallel to the movable support surface. At any given point, there are two cross-process directions pointing in opposite directions, i.e., an "inboard" cross-process direction and an "outboard" cross-process direction. Thus, considering the reference frames illustrated in the Figures, a cross-process direction is any direction parallel to the x-axis, including directions pointing in a positive or negative direction along the x-axis. References herein to a "cross-process direction" should be understood as referring generally to any of the cross-process directions, rather than to one specific cross-process direction, unless indicated otherwise by the context. Thus, for example, the statement "the valve is movable in a cross-process direction" means that the valve can move in an inboard direction, outboard direction, or both directions.

The terms "upstream" and "downstream" may refer to directions parallel to a process direction, with "downstream" referring to a direction pointing in the same direction as the process direction (i.e., the direction the print media are transported through the ink deposition assembly) and "upstream" referring to a direction pointing opposite the process direction. In the Figures, "upstream" corresponds to a negative y-axis direction, while "downstream" corresponds to a positive y-axis direction. The terms "upstream" and "downstream" may also be used to refer to a relative location of element, with an "upstream" element being displaced in an upstream direction relative to a reference point and a "downstream" element being displaced in a downstream direction relative to a reference point. In other words, an "upstream" element is closer to the beginning of the path the print media takes as it is transported through the ink deposition assembly (e.g., the location where the print media joins the movable support surface) than is some other reference element. Conversely, a "downstream" element is closer to the end of the path (e.g., the location where the print media leaves the support surface) than is some other reference element. The reference point of the other element to which the "upstream" or "downstream" element is compared may be explicitly stated (e.g., "an upstream side of a printhead"), or it may be inferred from the context.

The terms "inboard" and "outboard" refer to cross-process directions, with "inboard" referring to one to cross-process direction and "outboard" referring to a cross-process direction opposite to "inboard." In the Figures, "inboard" corresponds to a positive x-axis direction, while "outboard" corresponds to a negative x-axis direction. The terms "inboard" and "outboard" also refer to relative locations, with an "inboard" element being displaced in an inboard direction relative to a reference point and with an "outboard" element being displaced in an outboard direction relative to a reference point. The reference point may be explicitly stated (e.g., "an inboard side of a printhead"), or it may be inferred from the context.

The term "vertical" refers to a direction perpendicular to the movable support surface in the deposition region. At any given point, there are two vertical directions pointing in opposite directions, i.e., an "upward" direction and an "downward" direction. Thus, considering the reference frames illustrated in the Figures, a vertical direction is any direction parallel to the z-axis, including directions pointing in a positive z-axis direction ("up") or negative z-axis direction ("down").

The term "horizontal" refers to a direction parallel to the movable support surface in the deposition region (or tangent to the movable support surface in the deposition region, if the movable support surface is not flat in the deposition region). Horizontal directions include the process direction and cross-process directions.

The term "vacuum" has various meanings in various contexts, ranging from a strict meaning of a space devoid of all matter to a more generic meaning of a relatively low pressure state. Herein, the term "vacuum" is used in the generic sense, and should be understood as referring broadly to a state or environment in which the air pressure is lower than that of some reference pressure, such as ambient or atmospheric pressure. The amount by which the pressure of the vacuum environment should be lower than that of the reference pressure to be considered a "vacuum" is not limited and may be a small amount or a large amount. Thus, "vacuum" as used herein may include, but is not limited to, states that might be considered a "vacuum" under stricter senses of the term.

The term "air" has various meanings in various contexts, ranging from a strict meaning of the atmosphere of the Earth (or a mixture of gases whose composition is similar to that of the atmosphere of the Earth), to a more generic meaning of any gas or mixture of gases. Herein, the term "air" is used in the generic sense, and should be understood as referring broadly to any gas or mixture of gases. This may include, but is not limited to, the atmosphere of the Earth, an inert gas such as one of the Noble gases (e.g., Helium, Neon, Argon, etc.), Nitrogen ($N_2$) gas, or any other desired gas or mixture of gases.

In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically directly coupled, or they may be indirectly coupled via one or more intermediate components, unless specifically noted otherwise. Mathematical and geometric terms are not necessarily intended to be used in accordance with their strict definitions unless the context of the description indicates otherwise, because a person having ordinary skill in the art would understand that, for example, a substantially similar element that functions in a substantially similar way could easily fall within the scope of a descriptive term even though the term also has a strict definition.

Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

What is claimed is:

1. A printing system, comprising:

an ink deposition assembly comprising a carrier plate and a printhead arranged to eject a print fluid through a printhead opening in the carrier plate to a deposition region of the ink deposition assembly;

a media transport device comprising a movable support surface, the media transport device configured to hold a print medium against the movable support surface by vacuum suction through holes in the media transport device and transport the print medium along a process direction though the deposition region; and an airflow control system comprising an upstream valve disposed on an upstream side of the printhead and a downstream valve disposed on a downstream side of the printhead, upstream and downstream being defined based on the process direction, wherein each of the upstream valve and the downstream valve is transitionable between an open state and a closed state, wherein the upstream valve is configured to extend across and block airflow through an upstream gap defined between the printhead and a rim of the printhead opening in the closed state and allow airflow through the upstream gap in the open state, and wherein the downstream valve is configured to extend across and block airflow through a downstream gap defined between the printhead and the rim of the printhead opening in the closed state and allow airflow through the downstream gap in the open state.

2. The printing system of claim 1, further comprising:

wherein the upstream and downstream valves are individually transitionable between the open state and the closed state based on a position of an inter-media zone between adjacent print media held against the movable support surface.

3. The printing system of claim 2, further comprising:

a first actuator configured to actuate the upstream valve between the open state and the closed state;

a second actuator configured to actuate the downstream valve between the open state and the closed state; and a controller configured to cause the first and second actuators to selectively actuate the upstream and downstream valves between the open and closed states based on a position of an inter-media zone between adjacent print media held against the movable support surface.

4. The printing system of claim 3, wherein the controller is configured to cause the first and second actuators to:

actuate the upstream valve to the open state when the inter-media zone reaches a first position;

actuate the upstream valve to the closed state when the inter-media zone reaches a second position;

actuate the downstream valve to the open state when the inter-media zone reaches a third position; and actuate the downstream valve to the closed state when the inter-media zone reaches a fourth position.

5. The printing system of claim 4, wherein the fourth position is downstream of the third position and the third and second positions are downstream of the first position.

6. The printing system of claim 5, wherein the second and third positions are the same position.

7. The printing system of claim 3, wherein the controller is configured to dynamically determine respective trigger locations for actuating each of upstream and downstream valves by sensing an amount of image blur in a printed image and to adjust the respective trigger locations based on the sensed amount of image blur.

8. The printing system of claim 2, wherein the upstream and downstream valves comprise threshold valves.

9. The printing system of claim 8, wherein vacuum suction from the inter-media zone individually actuates each of the upstream and downstream valves to the open state when the inter-media zone is under the respective valve.

10. The printing system of claim 9, wherein each of the upstream and the downstream valves is in the closed state when the inter-media zone is not under the respective valve.

11. The printing system of claim 1, wherein each of the upstream and downstream valves extend along a cross- process direction, perpendicular to the process direction, and are rotated about an axis of rotation that is parallel to the cross-process direction while being actuated between the open state and the closed state.

12. The printing system of claim 1, wherein the media transport device comprises a vacuum platen, the holes extending through the vacuum platen; and wherein the movable support surface comprises a belt configured to move over a surface of the vacuum platen.

13. The printing system of claim 1, wherein the airflow control system comprises a plurality of channels individually transitionable between an on state and an off state, each of the channels associated with at least one column of the holes extending in the process direction, wherein, in the on state, each channel supplies vacuum suction to the at least one column of holes, and wherein, in the off state, each channel does not supply vacuum suction to the at least one column of holes.

14. The printing system of claim 13, wherein the airflow control system further comprises a plurality of channel valves respectively coupling the channels to a vacuum plenum, and wherein the channel valves are each individually actuatable between open and closed states to place the corresponding channel in the on and off states, respectively.

15. The printing system of claim 13, further comprising:

a controller configured to selectively place individual ones of the channels in the on and off states based on the size of the print medium.

16. A printing system, comprising:

an ink deposition assembly comprising a carrier plate and a printhead arranged to eject a print fluid through a printhead opening in the carrier plate to a deposition region of the ink deposition assembly;

a media transport device comprising a movable support surface, the media transport device configured to hold a print medium against the movable support surface by vacuum suction communicated from a vacuum plenum on a first side of the movable support surface through holes in the media transport device to the print medium on a second side of the movable support surface, and transport the print medium along a process direction though the deposition region, the holes arranged in columns extending in the process direction;

an airflow control system comprising a plurality of channels that are individually transitionable between an on state and an off state, wherein each of the channels is disposed on the first side of the movable support surface, is associated with at least one column of the holes, and is configured to control communication of vacuum suction from the vacuum plenum to the associated at least one column of the holes; and a controller configured to selectively place individual ones of the channels in the on and off states based on the size of the print medium, wherein each channel, in the on state, supplies vacuum suction from the vacuum plenum to the at least one column of holes, and wherein each channel, in the off state, does not supply vacuum suction to the at least one column of holes.

17. The printing system of claim 16, wherein the airflow control system further comprises a plurality of valves respectively coupling the channels to the vacuum plenum, and wherein the valves are each individually actuatable between open and closed states to place the corresponding channel in the on and off states, respectively.

18. A printing system, comprising:

an ink deposition assembly comprising a carrier plate and a printhead arranged to eject a print fluid through a printhead opening in the carrier plate to a deposition region of the ink deposition assembly;

a media transport device comprising a movable support surface, the media transport device configured to hold a print medium against the movable support surface by vacuum suction through holes in the media transport device and transport the print medium along a process direction though the deposition region, the holes arranged in columns extending in the process direction; and an airflow control system comprising:

an upstream valve disposed on an upstream side of the printhead and a downstream valve disposed on a downstream side of the printhead, wherein upstream and downstream are defined based on the process direction and each of the upstream valve and the downstream valve is transitionable between an open state and a closed state; and a plurality of channels that are individually transitionable between an on state and an off state, each of the channels associated with at least one column of the holes extending in the process direction, wherein the upstream valve is configured to extend across and block airflow through an upstream gap defined between the printhead and a rim of the printhead opening in the closed state and allow airflow through the upstream gap in the open state, and wherein the downstream valve is configured to extend across and block airflow through a downstream gap defined between the printhead and the rim of the printhead opening in the closed state and allow airflow through the downstream gap in the open state, wherein each channel, when in the on state, supplies vacuum suction to the associated column of holes, and wherein each channel, when in the off state, does not supply vacuum suction to the associated column of holes.

19. The printing system of claim 18, further comprising:

a controller configured to:

selectively place individual ones of the channels in the on and off states based on the size of the print medium; and selectively actuate the valves between the open and closed states based on a position of an inter-media zone between adjacent print media held against the movable support surface.

20. A method, comprising:

transporting a print medium along a process direction through a deposition region of a printhead of a printing system, wherein the print medium is held during the transporting against a movable support surface of a media transport device via vacuum suction through holes in the media transport device, the vacuum suction being communicated from a vacuum source to the holes via a vacuum plenum, the holes being arranged in columns extending in the process direction;

ejecting print fluid from the printhead through a printhead opening in a carrier plate to deposit the print fluid to the print medium in the deposition region;

controlling an airflow control system to selectively block airflow through upstream and downstream sides of the printhead opening by selectively actuating upstream and downstream valves between open and closed states, upstream and downstream being defined based on the process direction, wherein the upstream valve blocks airflow through the upstream side of the printhead opening in the closed state and allows airflow through the upstream side of the printhead opening in the open state, and wherein the downstream valve blocks airflow through a downstream side of the printhead opening in the closed state and allows airflow through the downstream side of the printhead opening in the open state; and controlling the airflow control system to selectively place individual ones of a plurality of channels in on and off states, wherein each of the channels is associated with at least one column of the holes extending in the process direction;

wherein each channel, when in the on state, supplies vacuum suction to the associated column of holes, and wherein each channel, when in the off state, does not supply vacuum suction to the associated column of holes.

21. The method of claim 20, wherein selectively actuating the upstream and downstream valves between the open and closed states comprises selectively actuating the valves based on a position of an inter-media zone between adjacent print media held against the movable support surface; and selectively placing individual ones of the plurality of channels in the on and off states comprises selectively placing individual ones of the channels in the on and off states based on the size of the print medium.

* * * * *